US009465357B2

(12) United States Patent
Moon et al.

(10) Patent No.: US 9,465,357 B2
(45) Date of Patent: Oct. 11, 2016

(54) CARTRIDGE AND ELECTROPHOTOGRAPHIC IMAGE FORMING APPARATUS USING THE SAME

(71) Applicant: SAMSUNG ELECTRONICS CO., LTD., Suwon-si, Gyeonggi-do (KR)

(72) Inventors: Ji-won Moon, Suwon-si (KR); Ho-jin Jang, Suwon-si (KR); Woong-yong Choi, Yongin-si (KR); Oh-dug Kwon, Suwon-si (KR); Yun-kyu Sim, Seoul (KR); Jong-in Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/540,698

(22) Filed: Nov. 13, 2014

(65) Prior Publication Data

US 2015/0261181 A1 Sep. 17, 2015

(30) Foreign Application Priority Data

Mar. 12, 2014 (KR) ..... 10-2014-0029157

(51) Int. Cl.
*G03G 21/18* (2006.01)
*G03G 15/08* (2006.01)

(52) U.S. Cl.
CPC ..... *G03G 21/1885* (2013.01); *G03G 15/0863* (2013.01); *G03G 21/1871* (2013.01); *G03G 2221/1823* (2013.01); *G03G 2221/1884* (2013.01)

(58) Field of Classification Search
CPC ..... G03G 21/1885; G03G 21/1871; G03G 21/1867; G03G 21/1882; G03G 2215/0697
See application file for complete search history.

(56) References Cited

U.S. PATENT DOCUMENTS

| | | | | |
|---|---|---|---|---|
| 6,266,503 | B1 * | 7/2001 | Murayama et al. | 399/117 |
| 6,834,173 | B2 * | 12/2004 | Yamaguchi et al. | 399/119 |
| 7,184,682 | B2 * | 2/2007 | Chadani et al. | 399/90 |
| 7,272,336 | B1 * | 9/2007 | Dawson et al. | 399/90 |
| 7,747,198 | B2 * | 6/2010 | Nakagami | 399/260 |
| 7,978,997 | B2 * | 7/2011 | Tokuda | 399/90 |
| 8,073,355 | B2 | 12/2011 | Lee et al. | |

(Continued)

FOREIGN PATENT DOCUMENTS

| | | | |
|---|---|---|---|
| JP | 2002-365863 | | 12/2002 |
| JP | 2004061596 A | * | 2/2004 |

(Continued)

OTHER PUBLICATIONS

European Office Action dated Mar. 13, 2015 in European Patent Application No. 14196962.6.

(Continued)

*Primary Examiner* — Minh Phan
*Assistant Examiner* — Leon W Rhodes, Jr.
(74) *Attorney, Agent, or Firm* — Staas & Halsey LLP

(57) ABSTRACT

A cartridge that is attached to or detached from a main body of an image forming apparatus. The cartridge includes a memory unit that includes a contact portion via which the cartridge is connected to the main body and is connected to the main body to transmit information of the cartridge to the main body. The contact portion is moved to a first position at which the contact portion is hidden inside the cartridge and a second position at which the contact portions is protruded out of the cartridge to be connected to a connection portion provided in the main body.

61 Claims, 31 Drawing Sheets

(56) References Cited

U.S. PATENT DOCUMENTS

| | | | | |
|---|---|---|---|---|
| 8,290,396 | B2 * | 10/2012 | Lee | G03G 21/1661 399/110 |
| 8,620,196 | B2 * | 12/2013 | Wu et al. | 399/262 |
| 8,634,743 | B2 * | 1/2014 | Akaike | G03G 21/12 399/110 |
| 8,864,292 | B2 | 10/2014 | Kanbe et al. | |
| 8,913,948 | B2 * | 12/2014 | Tyler et al. | 399/393 |
| 2006/0265742 | A1 | 11/2006 | Rommelmann et al. | |
| 2007/0059018 | A1 | 3/2007 | Tokuda | |
| 2007/0141889 | A1 | 6/2007 | Chadani et al. | |
| 2008/0240776 | A1 | 10/2008 | Ishikawa | |
| 2011/0129252 | A1 * | 6/2011 | Oda et al. | 399/119 |
| 2014/0072333 | A1 * | 3/2014 | Yamashita | G03G 21/1623 399/110 |

FOREIGN PATENT DOCUMENTS

| | | |
|---|---|---|
| JP | 2007-79284 | 3/2007 |
| JP | 2013-220649 | 10/2013 |
| KR | 10-2006-0011782 | 2/2006 |
| KR | 10-2009-0090913 | 8/2009 |

OTHER PUBLICATIONS

European Search Report dated Mar. 4, 2015 in European Patent Application No. 14196962.6.

International Search Report and Written Opinion of the International Searching Authority mailed Jan. 28, 2015 in International Patent Application No. PCT/KR2014/010467.

Korean Office Action issued Feb. 2, 2015 in Korean Patent Application No. 10-2014-0029157.

European Search Report dated Nov. 2, 2015 in European Patent Application No. 14196962.6.

Korean Office Action dated Jan. 12, 2016 in Korean Patent Application No. 10-2015-0181855.

European Communication dated May 6, 2016 in European Patent Application No. 14196962.6.

* cited by examiner

CARTRIDGE AND ELECTROPHOTOGRAPHIC IMAGE FORMING APPARATUS USING THE SAME

CROSS-REFERENCE TO RELATED APPLICATIONS

This application claims the benefit of Korean Patent Application No. 10-2014-0029157, filed on Mar. 12, 2014, in the Korean Intellectual Property Office, the disclosure of which is incorporated herein in its entirety by reference.

BACKGROUND

1. Field

One or more embodiments relate to an image forming apparatus capable of forming an image on a recording medium and a cartridge that is attached to or detached from the image forming apparatus.

2. Description of the Related Art

An image forming apparatus using electrophotography prints an image on a recording medium by supplying toner to an electrostatic latent image formed on a photoreceptor to form a visible toner image on the photoreceptor, transferring the visible toner image to the recording medium, and fusing the transferred visible toner image on the recording medium.

A process cartridge is an assembly of components for forming a visible toner image, and is a consumable product that is detachable from a main body of an image forming apparatus and replaceable after a life is ended. A process cartridge may have various structures such as a structure in which a photoreceptor, a development roller that supplies toner to the photoreceptor, and a container portion containing toner are integrally formed, a structure divided into an image cartridge including a photoreceptor and a development roller and a toner cartridge containing toner, or a structure divided into a photoreceptor cartridge including a photoreceptor, a development cartridge including a development roller, and a toner cartridge containing toner.

A cartridge includes a memory unit in which various types of information about the cartridge are stored. When the cartridge is mounted in a main body of an image forming apparatus, the memory unit is electrically connected to the main body to communicate with the main body and may transmit information about the cartridge to the main body. The memory unit includes a contact portion that is electrically connected to a connection portion of the main body.

SUMMARY

One or more embodiments include a cartridge capable of preventing pollution of a contact portion of a memory unit included in the cartridge and an image forming apparatus using the cartridge.

One or more embodiments include a cartridge capable of preventing damage to a contact portion of a memory unit and an image forming apparatus using the cartridge.

Additional aspects will be set forth in part in the description which follows and, in part, will be apparent from the description, or may be learned by practice of the presented embodiments.

According to one or more embodiments, a cartridge that is attached to or detached from a main body of an image forming apparatus, includes a memory unit that includes a contact portion via which the cartridge is connected to the main body and is connected to the main body to transmit information of the cartridge to the main body, wherein the contact portion is moved to a first position that is hidden in the cartridge and to a second position that protrudes out of the cartridge in order to be connected to a connection portion provided in the main body.

The cartridge may further include: a moving member, on which the contact portion is mounted, wherein the moving member is moved to the first or second position; and a knob that is connected to the moving member so as to move the moving member.

The cartridge may further include a protection member that is moved, as the contact portion is moved to the first or second position, to a retreat position that is hidden in the cartridge and a protruding position protruding out of the cartridge in order to be inserted into an insertion portion provided in the main body.

The protection member may be inserted into the insertion portion before the contact portion is connected to the connection portion so as to align the contact portion and the connection portion.

A front end portion of the protection member may be protruded further than a front end portion of the contact portion in a moving direction of the contact portion.

The contact portion may be moved in a length direction of the cartridge that is orthogonal to a mounting direction of the cartridge, wherein the protection member is disposed before the contact portion in the mounting direction of the cartridge.

The protection member may be integrally formed with the moving member.

The knob may be formed at a rear portion of the cartridge with respect to a mounting direction of the cartridge.

The cartridge may be attached to or detached from the main body through an opening portion formed in the main body, wherein the knob is installed at a portion of the cartridge facing the opening portion.

The cartridge may further include a handle to attach or detach the cartridge, wherein the knob is disposed adjacent to the handle.

The knob may be slid in a moving direction of the contact portion.

The handle may be pivotable between a holding position protruding from the cartridge and an accommodation position that is close to the cartridge, wherein the moving member is moved in connection with pivoting of the handle.

The cartridge may further include a connection member that is connected to the handle and is moved in a direction orthogonal to a moving direction of the contact portion according to pivoting of the handle, and includes a guide post, wherein an inclination guide groove, which is inclined with respect to the moving direction of the contact portion and into which the guide post is inserted, is formed in the knob.

The knob may be a rotational knob and the cartridge may further include: a pinion that rotates via the knob; and a rack gear that is formed on the moving member to be engaged with the pinion.

The cartridge may further include: a moving member on which the contact portion is mounted, wherein the moving member is moved to the first or second position; and a handle that is pivoted between a holding position protruding from the cartridge and a first accommodation position that is close to the cartridge, wherein the moving member is moved to the first or second position in connection with pivoting of the handle.

The cartridge may further include an accommodation portion that is dented so as to accommodate the handle located at the first accommodation position.

The cartridge may further include a conversion unit that converts pivotal movement of the handle to sliding movement of the moving member.

The handle may be slid from the holding position to a second accommodation position at which the handle is accommodated in the accommodation portion.

A pivot shaft of the handle may be connected to the conversion unit when the handle is located at the holding position and the first accommodation position, and when the handle is located at the second accommodation position, the pivot shaft of the handle may be released from the conversion unit.

The cartridge may further include a toner containing unit containing toner.

The cartridge may include: a development roller; and a toner containing unit containing toner to be supplied to the development roller.

The cartridge may include: a toner containing unit containing toner; a photoconductor on which an electrostatic latent image is formed; and a development roller that supplies the toner of the toner containing unit to the electrostatic latent image.

According to one or more embodiments, an image forming apparatus includes: a main body; and a cartridge described above that is attached to or detached from the main body.

According to one or more embodiments, an image forming apparatus includes: a main body having an opening portion and including a door that opens and closes the opening portion; and a cartridge that is attached to or detached from the main body through the opening portion, wherein the cartridge includes: a memory unit that includes a contact portion via which the cartridge is to be connected to the main body and is connected to the main body to transmit information of the cartridge to the main body; a moving member on which the contact portion is mounted, wherein the moving member is moved to a first position at which the contact portion is located inside the cartridge and a second position at which the contact portion protrudes out of the cartridge to be connected to a connection portion in the main body; and a knob that is connected to the moving member so as to move the moving member, wherein an interference portion that contacts the knob such that the door is not closed when the contact portion is located at the first position.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
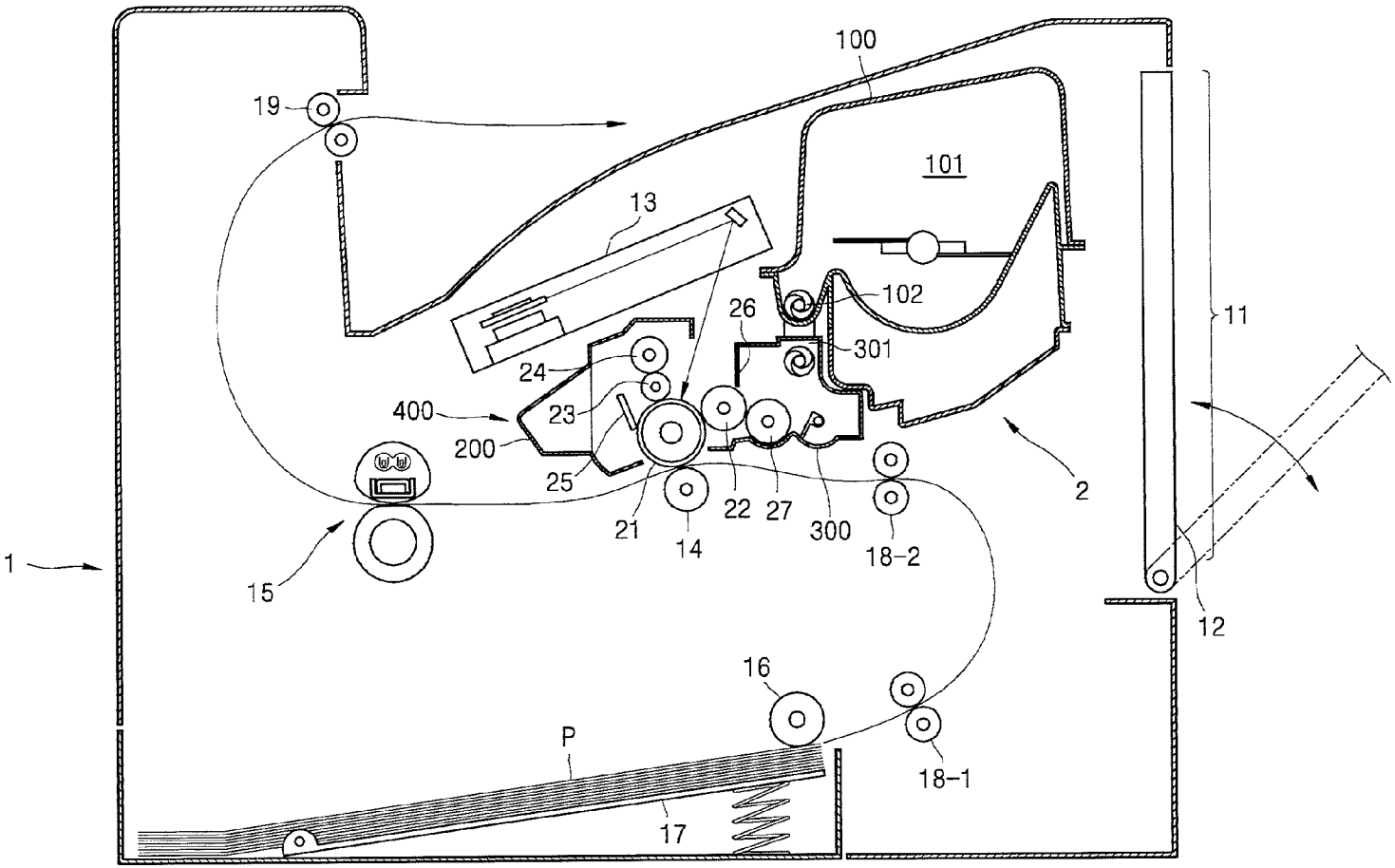
FIG. 1 is a schematic structural diagram of an electrophotographic image forming apparatus according to an embodiment.

Reference will now be made in detail to embodiments, examples of which are illustrated in the accompanying drawings, wherein like reference numerals refer to the like elements throughout. In this regard, the embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

FIG. 1 is a schematic structural diagram of an electrophotographic image forming apparatus according to an embodiment.

Referring to FIG. 1, a main body 1 and a process cartridge 2 are shown. The main body 1 includes an opening 11 providing a passage for the process cartridge 2 to be mounted or removed. A cover 12 closes or opens the opening 11. The main body 1 includes an exposure unit 13, a transfer roller 14, and a fusing unit 15. Also, the main body 1 includes a recording medium transfer structure for loading and transferring a recording medium P where an image is to be formed.

The process cartridge 2 may include a toner containing unit 101, a photoconductive drum 21, on a surface of which an electrostatic latent image is formed, and a development roller 22 that receives toner from the toner containing unit 101 to supply the toner to the electrostatic latent image so as to develop the electrostatic latent image to a visible toner image.

The photoconductive drum 21 is an example of a photoreceptor, wherein an electrostatic latent image is formed on a surface thereof, and may include a conductive metal pipe and a photosensitive layer around the conductive metal pipe. A charging roller 23 is an example of a charger for charging the photoconductive drum 21 to have uniform surface potential. A charging brush or a corona charger may be used instead of the charging roller 23. A reference numeral 24 denotes a cleaning roller for removing foreign materials on a surface of the charging roller 23. A cleaning blade 25 is an example of a cleaning unit for removing toner and foreign materials on a surface of the photoconductive drum 21 after a transfer process which is described later. A cleaning apparatus having another shape, such as a rotating brush, may be used instead of the cleaning blade 25.

Figure 2A:
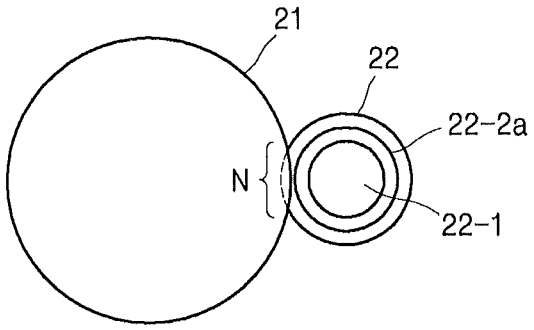
FIG. 2A is a diagram of an arrangement of a photoconductive drum and a development roller in a contact development method.
Figure 2B:
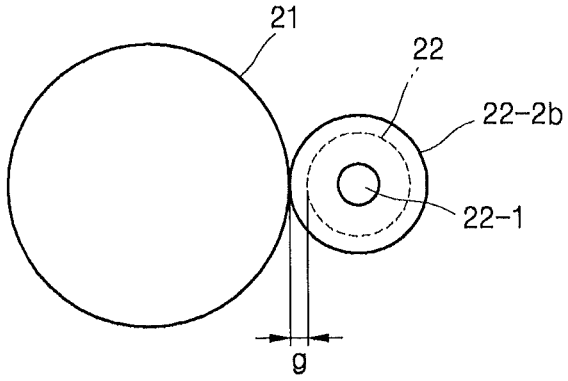
FIG. 2B is a diagram of an arrangement of a photoconductive drum and a development roller in a non-contact development method.

Examples of a development method include a one-component development method in which toner is used and a two-component development method in which toner and a carrier are used. The process cartridge 2 according to the current embodiment uses a one-component development method. The development roller 22 is used to supply toner to the photosensitive drum 21. A development bias voltage thereby to supply toner to the photosensitive drum 21 may be applied to the development roller 22. The one-component development method may be classified into a contact development method, wherein the development roller 22 and the photoconductive drum 21 are rotated while contacting each other, and a non-contact development method, wherein the development roller 22 and the photoconductive drum 21 are rotated by being spaced apart from each other by dozens to hundreds of microns. FIG. 2A is a diagram of an arrangement of the photoconductive drum 21 and the development roller 22 in the contact development method, and FIG. 2B is a diagram of an arrangement of the photoconductive drum 21 and the development roller 22 in the non-contact development method. Referring to FIG. 2A, in the contact development method, a gap maintaining member 22-2*a* having a smaller diameter than the development roller 22 may be provided on each of both ends of a rotation shaft 22-1 of the development roller 22. A contact amount of the development roller 22 to the photoconductive drum 21 is constrained as the gap maintaining member 22-2*a* contacts the surface of the photoconductive drum 21. A development nip N is formed as the development roller 22 contacts the photoconductive drum 21. Referring to FIG. 2B, in the non-contact development method, a gap maintaining member 22-2*b* having a larger diameter than the development roller 22 may be provided on each of the both ends of the rotation shaft 22-1 of the development roller 22. A development gap g between the development roller 22 and the photoconductive drum 21 is constrained as the gap maintaining member 22-2*b* contacts the surface of the photoconductive drum 21.

A regulator 26 constrains an amount of toner supplied by the development roller 22 to a development region where the photoconductive drum 21 and the development roller 22 face each other. The regulator 26 may be a doctor blade elastically contacting a surface of the development roller 22. A supply roller 27 supplies toner in the process cartridge 2 to a surface of the development roller 22. To this end, a supply bias voltage may be applied to the supply roller 27.

When a two-component development method is used, the development roller 22 is spaced apart from the photoconductive drum 21 by dozens to hundreds of microns. Although not illustrated in the drawings, the development roller 22 may have a structure in which a magnetic roller is disposed in a hollow cylindrical sleeve. The toner is adhered to a surface of a magnetic carrier. The magnetic carrier is adhered to the surface of the development roller 22 to be transferred to the development region where the photoconductive drum 21 and the development roller 22 face each other. Only the toner is supplied to the photoconductive drum 21 according to the development bias voltage applied between the development roller 22 and the photoconductive drum 21, and thus the electrostatic latent image formed on the surface of the photoconductive drum 21 is developed into the visible toner image. The process cartridge 2 may include an agitator (not shown) for mixing and stirring the toner and a carrier and transporting the mixture to the development roller 22. The agitator may be an auger, and a plurality of the agitators may be prepared in the process cartridge 2.

The exposure unit 13 forms the electrostatic latent image on the photoconductive drum 21 by irradiating light modulated according to image information to the photoconductive drum 21. The exposure unit 13 may be a laser scanning unit (LSU) using a laser diode as a light source, or a light-emitting diode (LED) exposure unit using an LED as a light source.

The transfer roller 14 is an example of a transfer unit for transferring a toner image from the photoconductive drum 21 to the recording medium P. A transfer bias voltage for transferring the toner image to the recording medium P is applied to the transfer roller 14. A corona transfer unit or a transfer unit using a pin scorotron method may be used instead of the transfer roller 14.

The recording media P are picked up one by one from a loading table 17 by a pickup roller 16, and are transferred by feed rollers 18-1 and 18-2 to a region where the photoconductive drum 21 and the transfer roller 14 face each other.

The fusing unit 15 applies heat and pressure to an image transferred to the recording medium P so as to fuse the image on the recording medium P. The recording medium P that passed through the fusing unit 15 is discharged outside the main body 1 by a discharge roller 19.

According to the above structure, the exposure unit 13 irradiates the light modulated according to the image information to the photoconductive drum 21 to develop the electrostatic latent image. The development roller 22 supplies the toner to the electrostatic latent image to form the visible toner image on the surface of the photoconductive drum 21. The recording medium P loaded in the loading table 17 is transferred to the region where the photoconductive drum 21 and the transfer roller 14 face each other by the pickup roller 16 and the feed rollers 18-1 and 18-2, and the toner image is transferred on the recording medium P from the photoconductive drum 21 according to the transfer bias voltage applied to the transfer roller 14. After the recording medium P passes through the fusing unit 15, the toner image is fused on the recording medium P according to heat and pressure. After the fusing, the recording medium P is discharged by the discharge roller 19.

The process cartridge 2 may have a first structure divided into an imaging cartridge 400 including the photoconductive drum 21 and the development roller 22 and a toner cartridge 100 including the toner containing unit 101, a second structure divided into a photoreceptor cartridge 200 including the photoconductive drum 21, a development cartridge 300 including the development roller 22, and a toner cartridge 100 including the toner containing unit 101, a third structure divided into a photoreceptor cartridge 200 and a development cartridge 300 including the toner containing unit 101, or a fourth structure in which a photoreceptor cartridge 200, a development cartridge 300, and a toner cartridge 100 are integrally formed with one another.

In the process cartridge 2 having the first structure (or the second structure), when the toner cartridge 100 is mounted in a main body 1, the toner cartridge 100 is connected to the imaging cartridge 400 (or the development cartridge 300). For example, when the toner cartridge 100 is mounted in the main body 1, a toner discharging unit 102 of the toner cartridge 100 and a toner inlet portion 301 of the imaging cartridge 400 (or the development cartridge 300) are connected to each other.

Figure 3A:
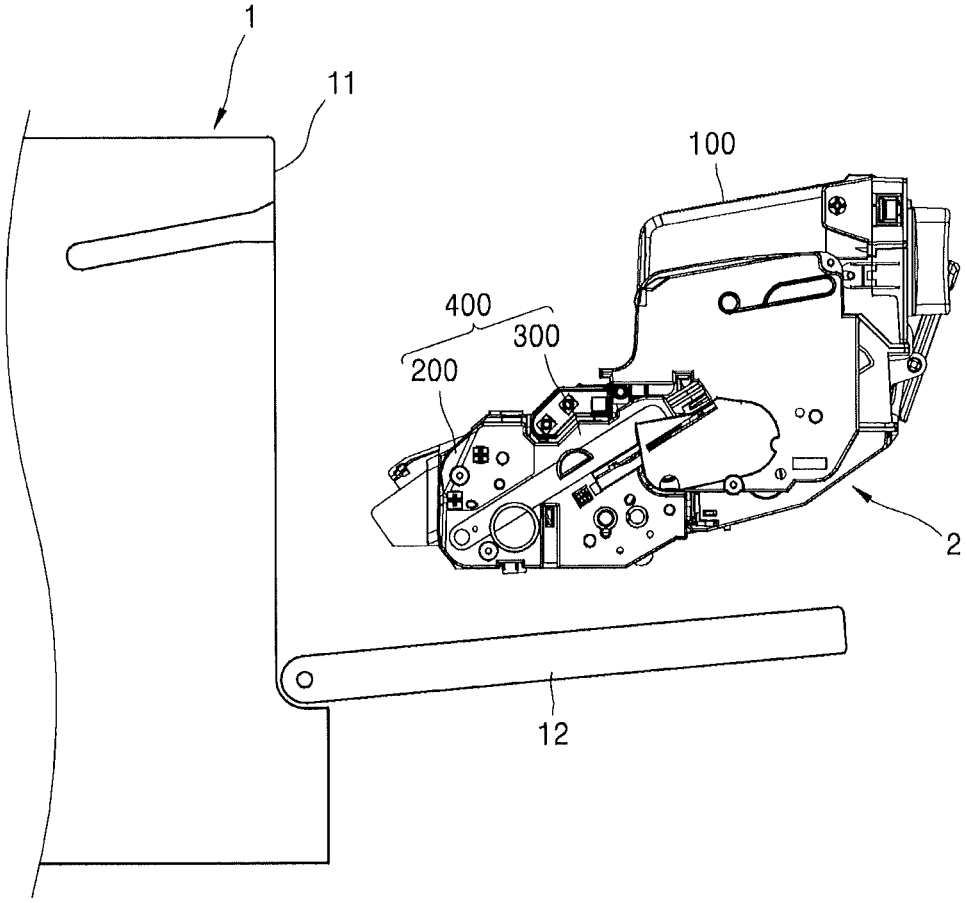
FIG. 3A illustrates replacement of a process cartridge.
Figure 3B:
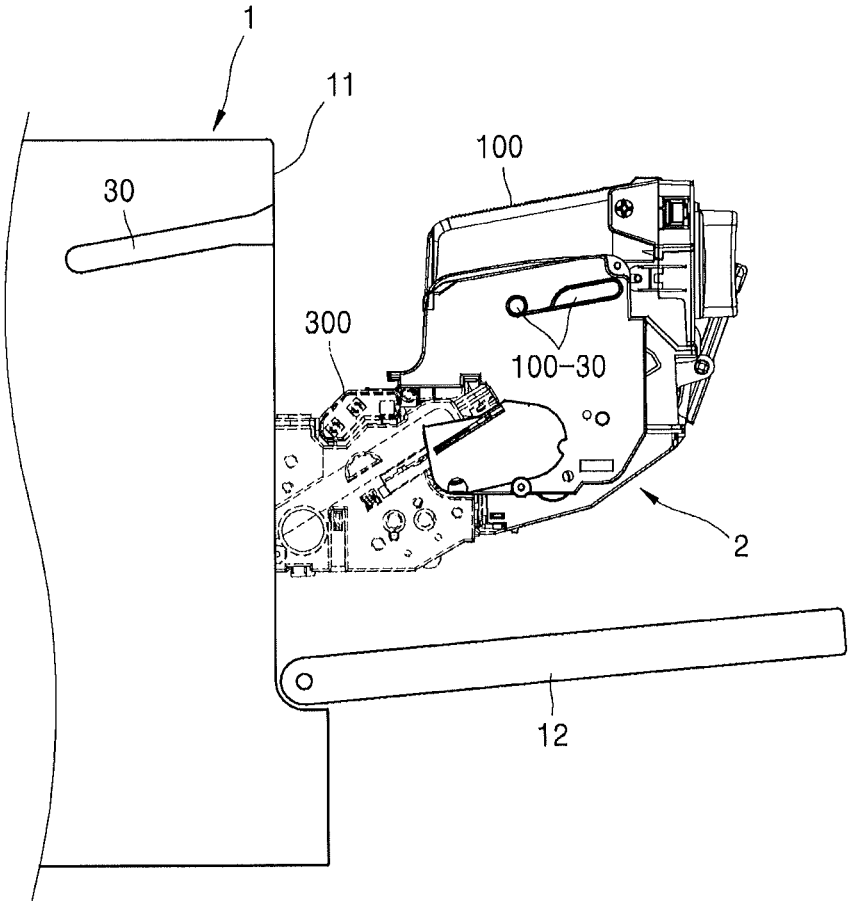
FIG. 3B illustrates replacement of a toner cartridge.

The process cartridge 2 is a consumable product that is replaced after its life is expired. The process cartridge 2 is attached to or detached from the main body 1 via the opening portion 11. In the case of the process cartridge 2 having the fourth structure, when toner contained in the toner containing unit 101 is consumed completely, the process cartridge 2 as a whole is replaced as illustrated in FIG. 3A. In general, the life of the imaging cartridge 400 is longer than the life of the toner cartridge 100. By using he process cartridge 2 having the first structure, the second structure or the third structure, the toner cartridge 100 or the development cartridge 300 in which the toner cartridge 100 or the toner containing unit 101 is integrally formed may be individually replaced as illustrated in FIG. 3B, and thus, costs for replacement of consumables may be reduced. The process cartridge 2 according to the current embodiment of the present invention has the first structure. Referring to FIG. 3B, a guide rail 30 that guides the toner cartridge 100 is included in the main body 1, and a guide protrusion 100-30 which is inserted into the guide rail 30 may be formed on the toner cartridge 100.

Figure 4:
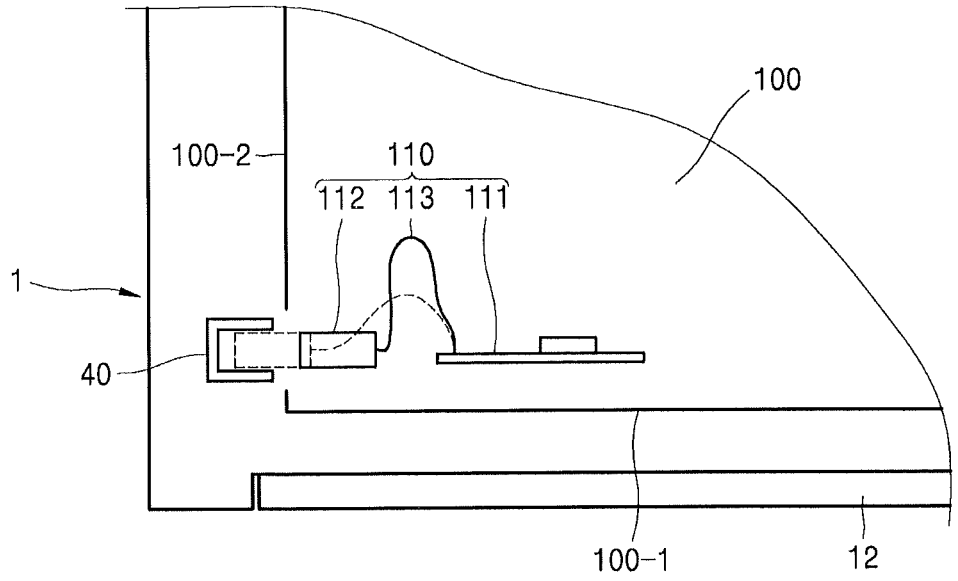
FIG. 4 is a plan view of an image forming apparatus according to an embodiment, illustrating a connection structure between a memory unit and a main body.

FIG. 4 is a partial plan view of the image forming apparatus according to an embodiment. Referring to FIG. 4, the memory unit 110 is included in the toner cartridge 100. When the toner cartridge 100 is mounted in the main body 1, the memory unit 110 is electrically connected to the main body 1 to transmit information of the toner cartridge 100 to the main body 1. The main body 1 may determine whether the toner cartridge 100 is mounted, by determining whether the memory unit 110 is electrically connected to the main body 1, for example, by determining whether communication with the memory unit 110 is possible or not.

The memory unit 110 may include a circuit unit 111 to monitor or manage a state of the toner cartridge 100 and a contact portion 112 via which the memory unit 110 is connected to the main body 1. The circuit unit 111 may include a customer replaceable unit monitor (CRUM) unit including a central processing unit (CPU) that performs at least one of authentication and/or coding of data communication with respect to the main body 1 by using, for example, an operating system (OS) included in the circuit unit 111. The circuit unit 111 may further include a memory. The memory may store various types of information about the toner cartridge 100. For example, specific information such as manufacturer information, manufacture date information, a serial number, or a model number, various programs, electronic signature information, and usage state (for example, a number of pages printed so far, a number of remaining printable pages, or an amount of toner left). Also, the memory may store even the lifetime or setup menus of the toner cartridge 100. In addition, the circuit unit 111 may include a functional block capable of performing various functions for communication, authentication, or coding. The circuit unit 111 may be in the form of a chip including a CPU, a chip including a memory and a CPU, or a printed circuit board on which chips and circuit elements for implementing various functional blocks are mounted.

The contact portion 112 may be integrally formed with the printed circuit board of the circuit unit 111, or may be connected to the circuit unit 111 via a signal line 113 as illustrated in FIG. 4. The contact portion 112 may be, for example, a modular jack. A connection portion 40 that is connected to the contact portion 112 is included in the main body 1. The connection portion 40 may be in the form of a modular connector into which the contact portion 112 in the form of a modular jack is inserted. Also, the contact portion 112 may be in the form of a conductive pattern. The contact portion 112 in the form of a conductive pattern may be formed on a circuit board which is not shown, or may be integrally formed with a printed circuit board of the circuit unit 111. The memory unit 110 is in the form of a package, in which the circuit unit 111 is included and from which the contact portion 112 is exposed to the outside, and the contact portion 112 may be in the form of a conductive pattern and may be exposed out of the package. In this case, the connection portion 40 may include a pin type terminal that is electrically connectable to the contact portion 112 which is in the form of a conductive pattern. Also, the contact portion 112 may be a pin type terminal, and the connection portion 40 may be in the form of a conductive pattern to which the pin type terminal is connected. Alternatively, the contact portion 112 and the connection portion 40 may have various forms whereby they may be electrically connected to each other.

As illustrated in FIG. 4 by a dotted line, when the contact portion 112 is protruded out of the toner cartridge 110, the contact portion 112 may be polluted or damaged while handling the toner cartridge 100. Also, when mounting the toner cartridge 100 in the main body 1, the contact portion 112 may be damaged due to collision with the main body 1. Damage to or pollution of the contact portion 112 may be the cause of a contact defect between the contact portion 112 and the connection portion 40. To solve this problem, the memory unit 110 includes the contact portion 112 that is movable to a first position (a position illustrated in FIG. 4 by a solid line) that is hidden inside the toner cartridge 100 and a second position (a position illustrated in FIG. 4 by a dotted line) that is protruded from the toner cartridge 100. When the toner cartridge 100 is mounted in the main body 1, the contact portion 112 is moved to the second position at which the contact portion 112 is electrically connected to the connection portion 40 included in the main body 1, and before the toner cartridge 100 is detached from the main body 1, the contact portion 112 is moved to the first position where electrical connection between the contact portion 112 and the connection portion 40 is terminated. A protruding direction of the contact portion 112 at the second position is not limited. The contact portion 112 may be protruded in various directions, for example, to a side portion 100-2, an upper portion, a lower portion, a front portion, or a rear portion 100-1 of the toner cartridge 100. Hereinafter, an embodiment will be described in which the contact portion 112 is moved in a length direction of the toner cartridge 100 that is orthogonal to a mounting direction A, so as to be protruded to the side portion 100-2 of the toner cartridge 100.

Figure 5A:
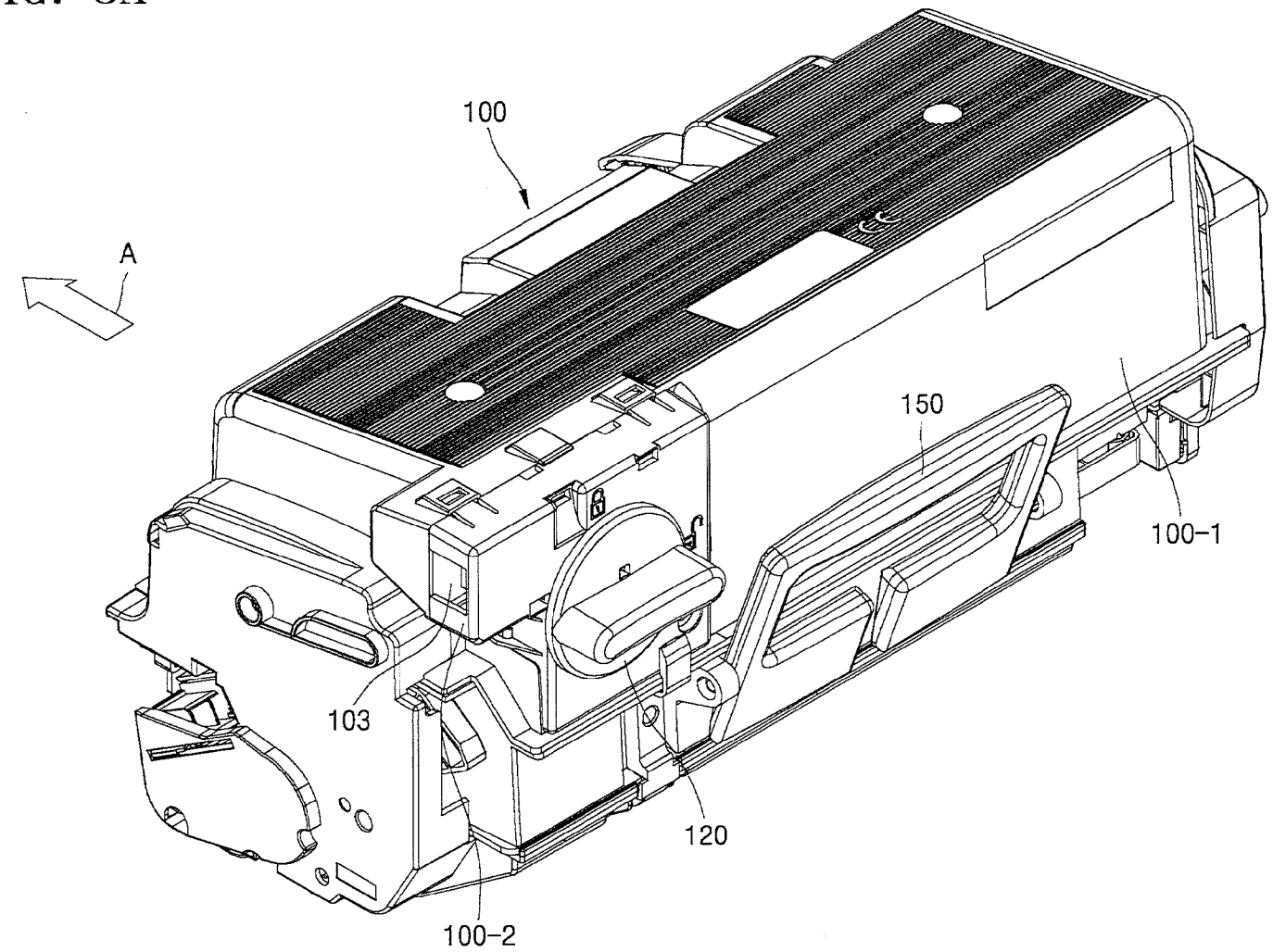
FIG. 5A is a perspective view of a toner cartridge having a movement structure for moving a contact portion to first or second position via manual manipulation, wherein the contact portion is located at the first position.
Figure 5B:
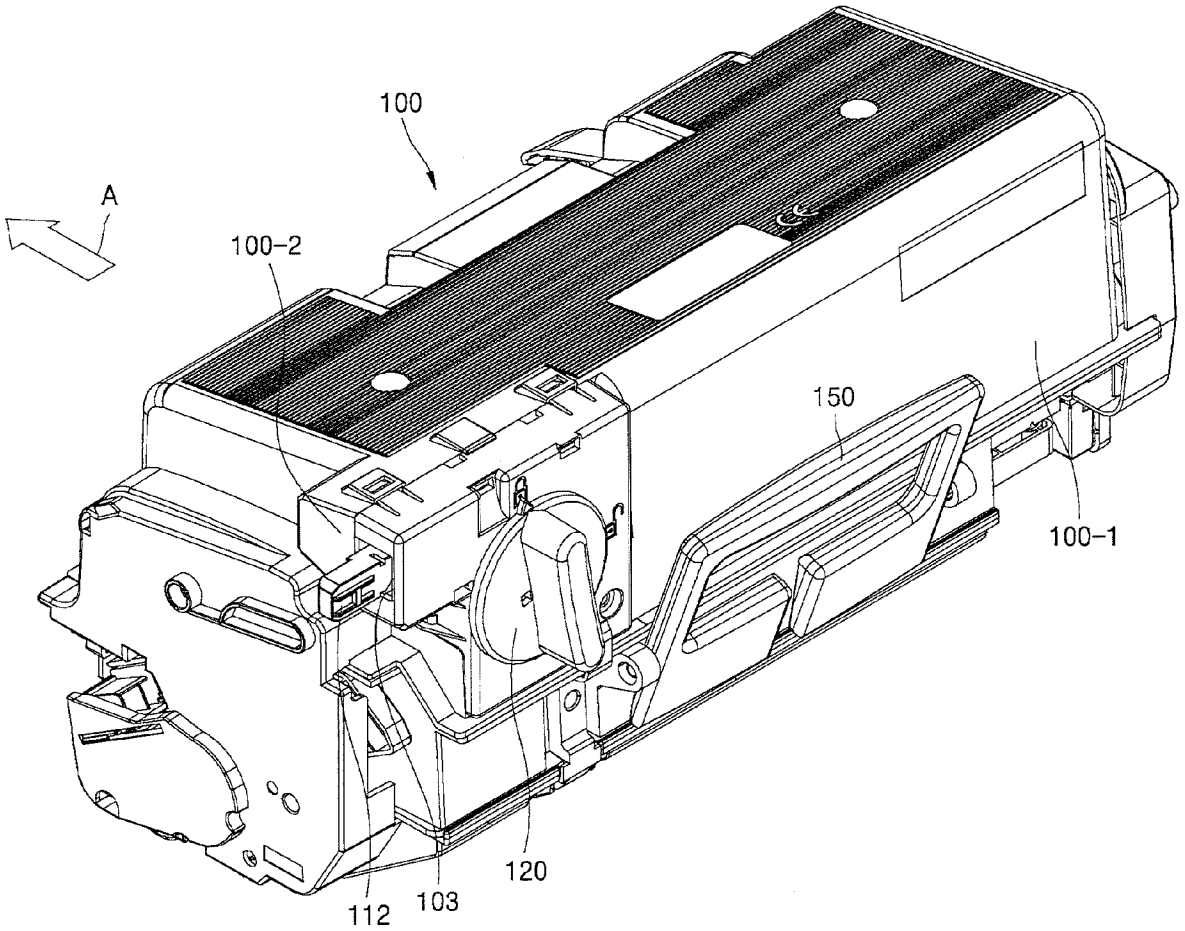
FIG. 5B is a perspective view of a toner cartridge having a movement structure for moving a contact portion to first or second position via manual manipulation, wherein the contact portion is located at the second position.
Figure 6:
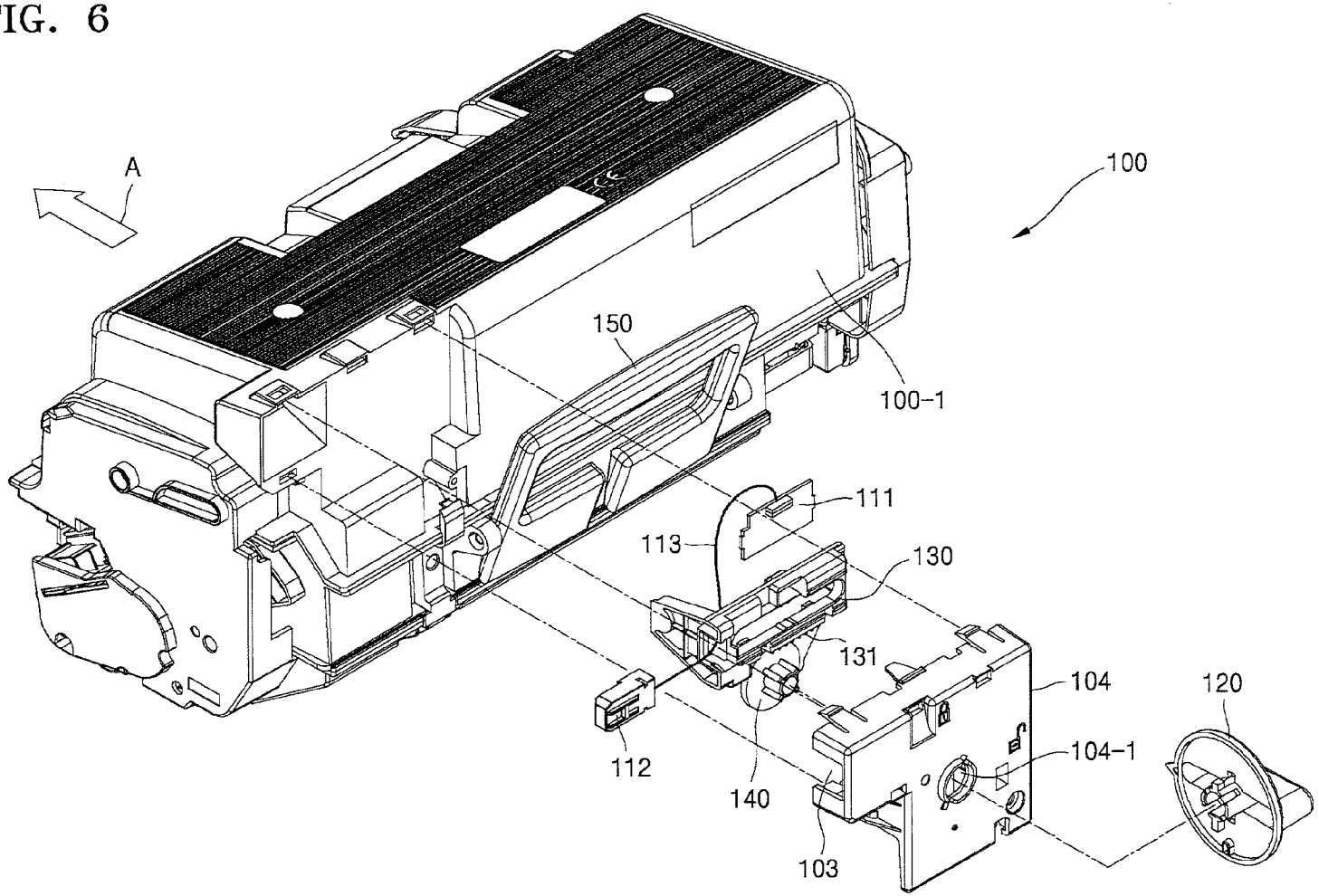
FIG. 6 is an exploded view of the toner cartridge of FIG. 5A.

The contact portion 112 may be moved to the first or second position via manual manipulation of a user. FIGS. 5A and 5B are perspective views of the toner cartridge 100 having a movement structure for moving the contact portion 112 to the first or second position via manual manipulation, according to an embodiment. FIG. 5A illustrates the contact portion 112 located at the first position, and FIG. 5B illustrates the contact portion 112 located at the second position. FIG. 6 is an exploded view of the toner cartridge 100 of FIG. 5A.

Referring to FIGS. 5A and 5B, with respect to the mounting direction A, a knob 120 is formed at a rear portion 100-1 of the toner cartridge 100. A first exit 103 through which the contact portion 112 goes in and out is formed at the side portion 100-2 of the toner cartridge 100. When the contact portion 112 is located at the first position as illustrated in FIG. 5A, the contact portion 112 is accommodated inside the toner cartridge 100 and is not exposed through the first exit 103. In this state, as illustrated in FIG. 3, a door 12 is opened and the toner cartridge 100 is mounted in the main body 1 through the opening portion 11 of the main body 1. Next, the knob 120 is accessed via the opening portion 11 of the main body 1 to rotate the knob 120 to move the contact portion 112 to the second position as illustrated in FIG. 5B. Then the contact portion 112 is protruded from the side portion 100-2 of the toner cartridge 100 through the exit 103, and as illustrated in FIG. 4 by a dotted line, the contact portion 112 is coupled to the connection portion 40 of the main body 1 so as to electrically connect the memory unit 110 and the main body 1.

Referring to FIG. 6, a moving member 130 is slidably installed in the toner cartridge 100. The moving member 130 is slidably installed in an inner portion of a rear cover 104 that is coupled to the rear portion 100-1 of the toner cartridge 100. The contact portion 112 is fixed to the moving member 130 and is connected to the circuit unit 111 via the signal line 113. The knob 120 is connected to the moving member 130 via a conversion unit. Rotation of the knob 120 is converted into a linear sliding movement of the moving member 130 via the conversion unit. For example, the conversion unit may be realized by a pinion 140 and a rack gear 131. The rack gear 131 is formed on the moving member 130. The pinion 140 is installed in the inner portion of the rear cover 104 to be engaged with the rack gear 131. The knob 120 is inserted into an installation hole 104-1 formed in the rear cover 104 to be connected to the pinion 140.

According to the above structure, when the knob 120 is rotated, rotation of the knob 120 is converted into linear movement of the moving member 130 via the pinion 140 and the rack gear 131, and the contact portion 112 is moved to the first position which is hidden inside the toner cartridge 100 illustrated in FIG. 5A and the second position protruding from the side portion 100-2 of the toner cartridge 100 as illustrated in FIG. 5B. A movement direction of the contact portion 112 is determined according to a structure of the conversion unit. For example, a first bevel gear (not shown) may be used as the pinion 140, and a second bevel gear (not shown) that is engaged with the pinion 140 and a spur gear (not shown) that is coaxial to the second bevel gear may be disposed between the rack gear 131 and the pinion 140 so that the spur gear and the rack gear 131 are engaged with each other. The conversion unit having the above-described structure may be implemented by referring to FIG. 18 which will be described later. By using the conversion structure having the above-described structure, the moving member 130 may be moved in a width direction or a height direction of the toner cartridge 100, and the contact portion 112 may protrude from a front portion or upper portion of the toner cartridge 100 to be located at the second position.

The knob 120 is located at a position facing the opening portion 11 when the toner cartridge 100 is mounted to the main body 1 so that a user may easily access the knob 120 via the opening portion 11 that is opened via the door 12 when the toner cartridge 100 is attached to or detached from the main body 1. For example, the knob 120 may be located at the rear portion 100-1 of the toner cartridge 100 with respect to the mounting direction A of the toner cartridge 100. A handle 150 may be formed at the toner cartridge 100 for the user to hold the toner cartridge 100 in an attaching or detaching operation, and the knob 120 may be disposed adjacent to the handle 150. Accordingly, when the user attaches or detaches the toner cartridge 100, the user may easily recognize and manipulate the knob 120.

Figure 7:
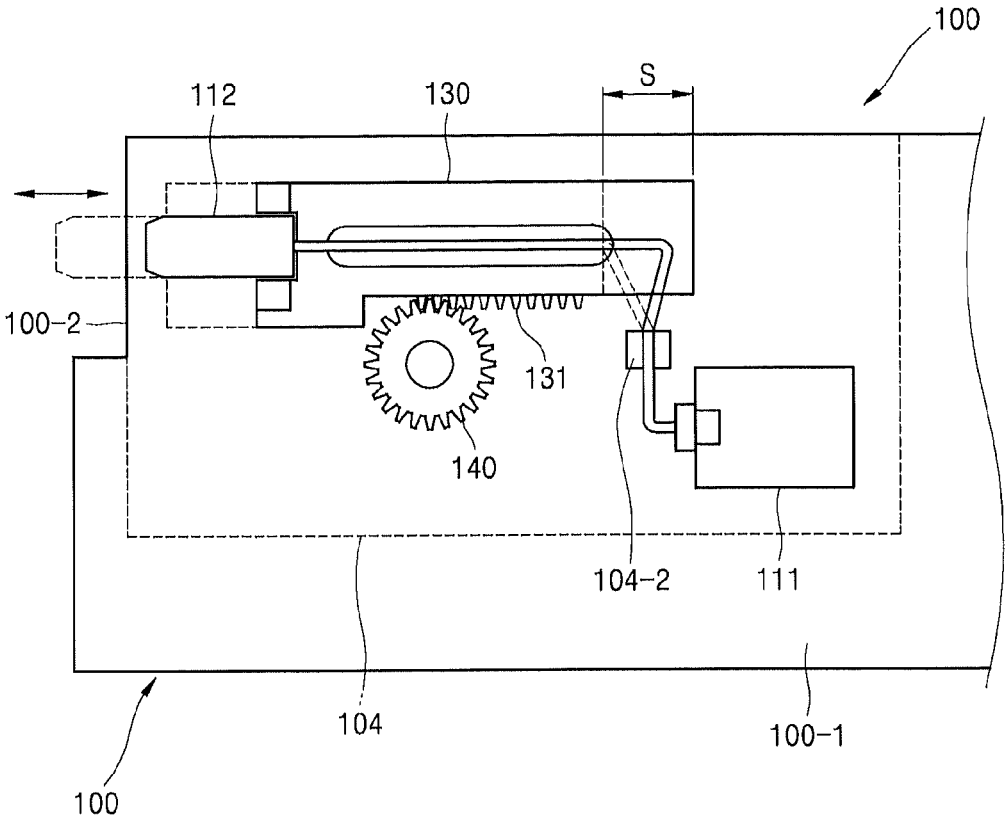
FIG. 7 is a rear view of a toner cartridge having a movement structure, in which a circuit portion of a memory unit is located at a fixed location and a contact portion is moved to first or second position, according to an embodiment.

According to the embodiment of FIGS. 5A, 5B, and 6, the circuit unit 111 is mounted on the moving member 130 and is moved with the contact portion 112. According to the above structure, while the contact portion 112 is being moved to the first or second position, relative positions of the contact portion 112 and the circuit unit 111 are not changed, and thus, a possibility of a short circuit of the signal line 113 with respect to the contact portion 112 and the circuit unit 111 may be significantly reduced. However, the embodiments of the present disclosure are not limited thereto. For example, the contact portion 112 may be integrally formed with the circuit unit 111 and the signal line 113 may be omitted. Alternatively, as illustrated in FIG. 7, the circuit unit 111 may be fixed to the rear cover 104 or the toner cartridge 100 and just the contact portion 112 may be installed in the moving member 130. In this case, a wire holder 104-2 that is formed on the rear cover 104 and supports the signal line 113 may be located at an intermediate position of a stroke S when the contact portion 112 is moved to the first or second position. Accordingly, while the contact portion 112 is being moved, a variation in a length of the signal line 113 between the contact portion 112 and the circuit unit 111 may be minimized to thereby reduce the danger of a short circuit between the signal line 113 and the contact portion 112 or the circuit unit 111.

The toner cartridge 100 is mounted in the main body 1 while the contact portion 112 is located at the first position (FIG. 5A). After the toner cartridge 100 is mounted in the main body 1, the contact portion 112 is moved to the second position (FIG. 5B) to be connected to the connection portion 40 of the main body 1. Also, in order to detach the toner cartridge 100 from the main body 1, first, the contact portion 112 is to be returned to the first position to release connection with respect to the connection portion 40, and then the toner cartridge 100 is to be detached from the main body 1. If the toner cartridge 100 is mounted in the main body 1 while the contact portion 112 is located at the second position, the contact portion 112 may collide with the main body 1 or the connection portion 40 and the contact portion 112 may be damaged. Also, if the toner cartridge 100 is detached from the main body 1 while the contact portion 112 is located at the second position, the connection portion 40 or the contact portion 112 may be damaged.

Figure 8:
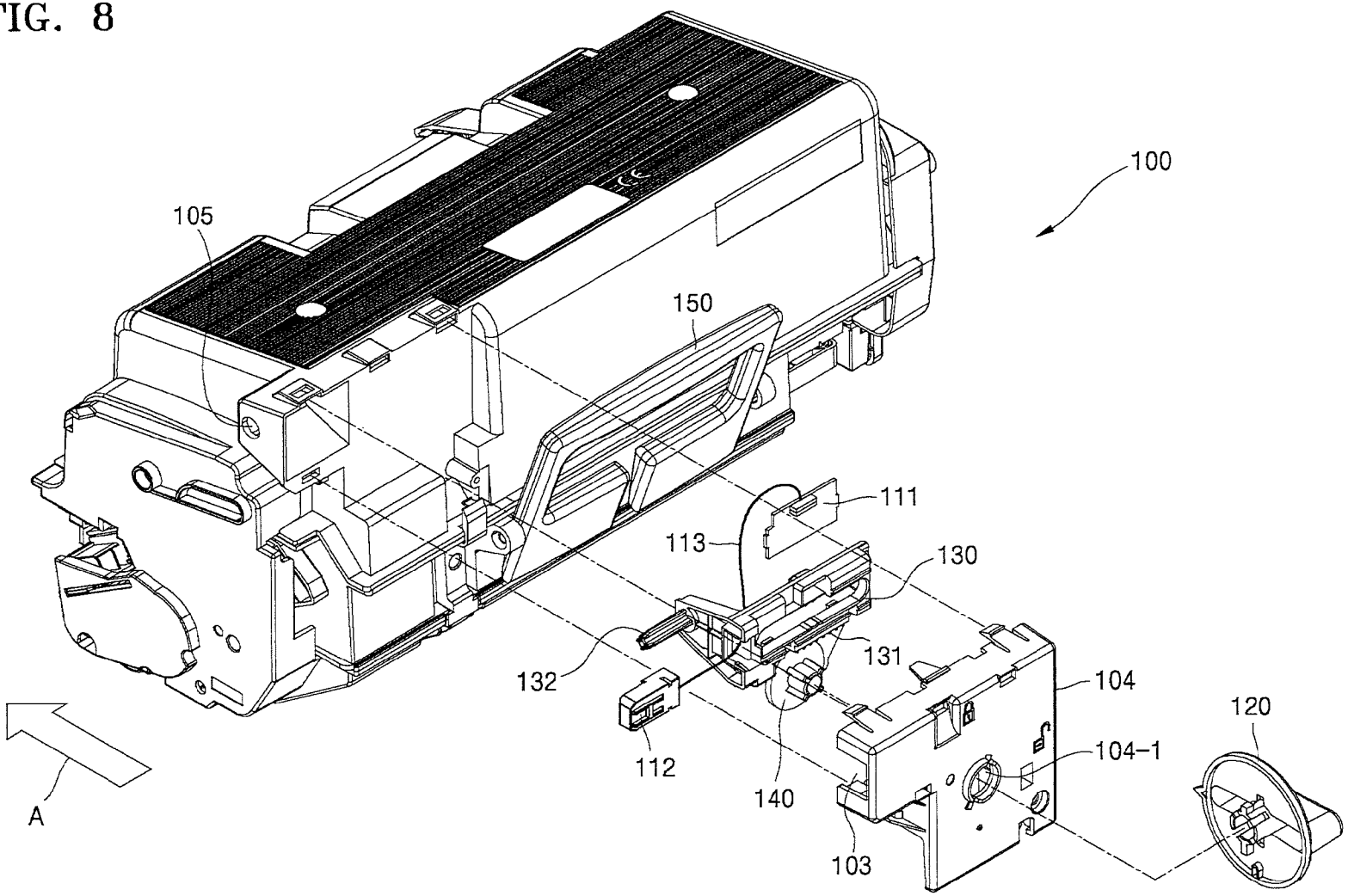
FIG. 8 is an exploded perspective view of a toner cartridge according to an embodiment.
Figure 9A:
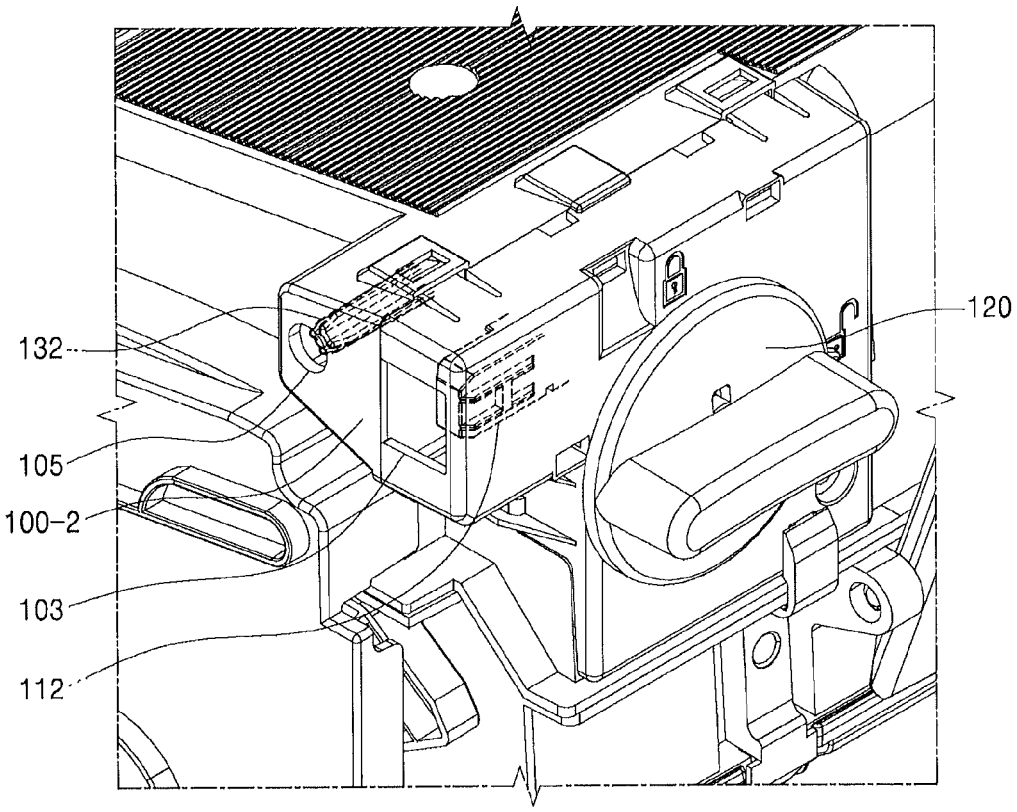
FIG. 9A is a perspective view of the toner cartridge illustrated in FIG. 8 according to an embodiment, wherein a protection member is located at a retreat position.
Figure 9B:
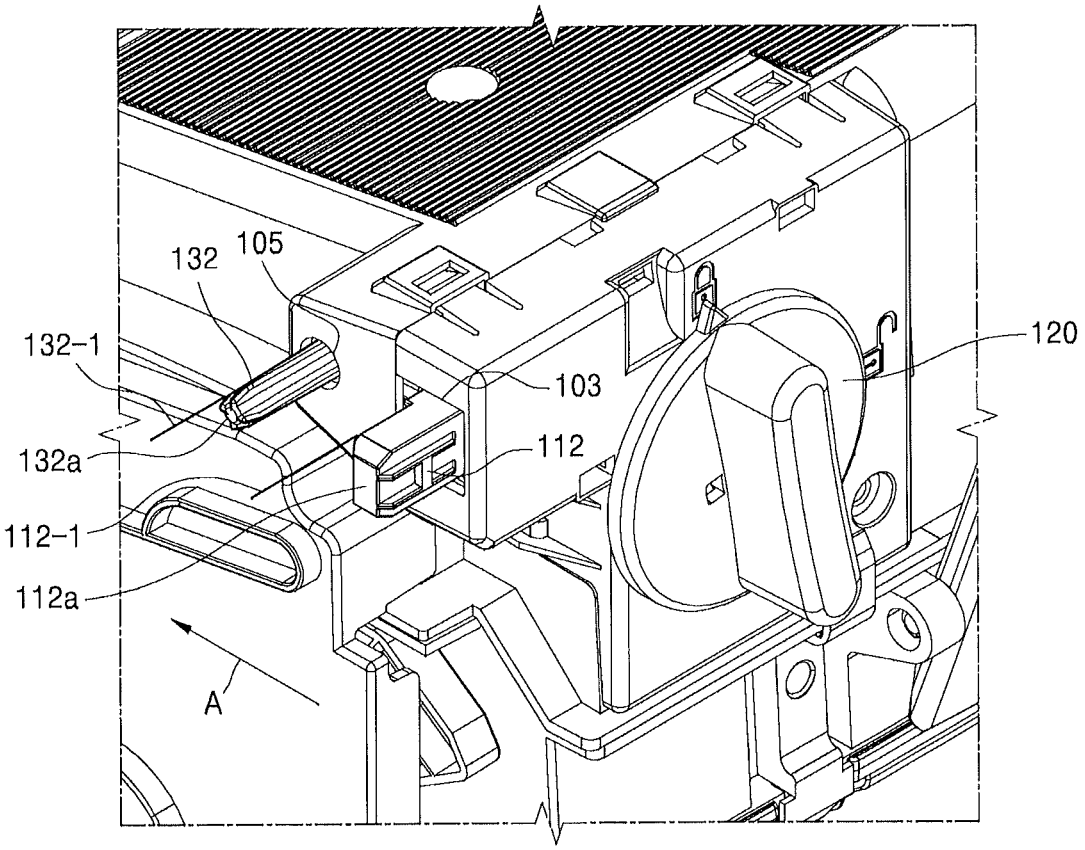
FIG. 9B is a perspective view of the toner cartridge illustrated in FIG. 8 according to an embodiment, wherein a protection member is located at a protruding position.
Figure 10A:
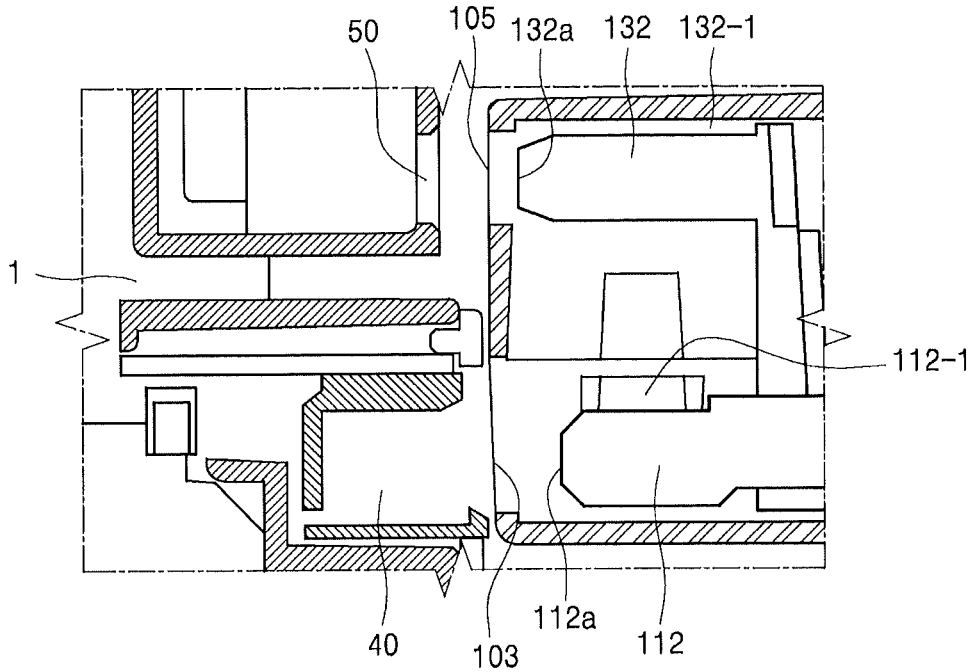
FIG. 10A is a plan view illustrating the toner cartridge illustrated in FIG. 8 mounted in the main body, wherein a contact portion and a protection member are respectively located at a first location and a retreat location.
Figure 10B:
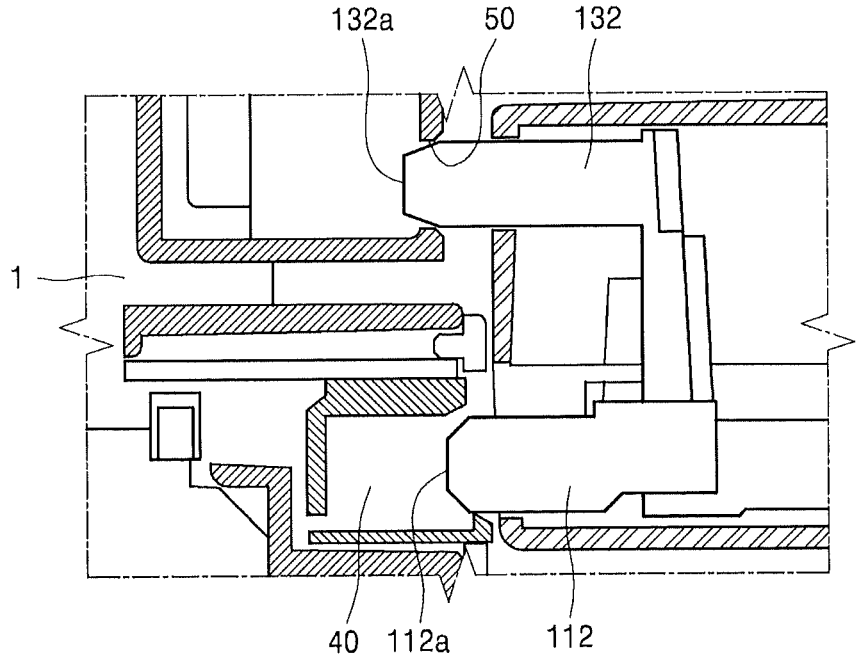
FIG. 10B is a plan view illustrating the toner cartridge illustrated in FIG. 8 mounted in the main body, wherein a contact portion and a protection member are respectively moved to a second location and a protruding location.
Figure 10C:
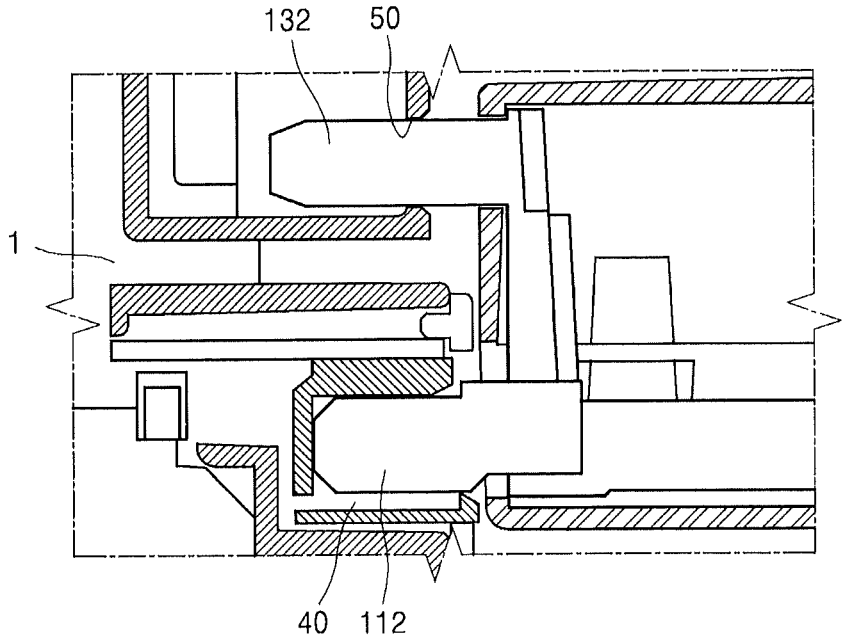
FIG. 10C is a plan view illustrating the toner cartridge illustrated in FIG. 8 mounted in the main body, wherein a contact portion and a protection member are respectively located at a second location and a protruding location.

FIG. 8 is an exploded perspective view of the toner cartridge 100 according to an embodiment. FIG. 9A is a perspective view of the toner cartridge 100, wherein a protection member 132 is located at a retreat position. FIG. 9B is a perspective view of the toner cartridge 100, wherein the protection member 132 is located at a protruding position. FIG. 10A is a plan view illustrating the toner cartridge 100 mounted in the main body 1, wherein the contact portion 112 and the protection member 132 are respectively located at the first position and the retreat position. FIG. 10B is a plan view illustrating the toner cartridge 100 mounted in the main body 1, wherein the contact portion 112 and the protection member 132 are respectively moved to the second position and the protruding position. FIG. 10C is a plan view illustrating the toner cartridge 100 mounted in the main body 1, wherein the contact portion 112 and the protection member 132 are respectively located at the second position and the protruding position.

Referring to FIG. 8, the protection member 132 that prevents collision between the contact portion 112 and the main body 1 or the connection portion 40 is illustrated. The protection member 132 is moved together with the contact portion 112 via manipulation of the knob 120. That is, the protection member 132 has a retreat position which is hidden inside the toner cartridge 100 and a protruding position protruding from the toner cartridge 100. For example, the protection member 132 may be integrally formed with the moving member 130.

According to the above structure, when the contact portion 112 is located at the first position as illustrated in FIG. 9A, the protection member 132 is located at the retreat position which is accommodated in the toner cartridge 100. When the contact portion 112 is located at the second position as illustrated in FIG. 9B as the knob 120 rotates, the protection member 132 is located at the protruding position protruding from the side portion 100-2 of the toner cartridge 100 via a second exit 105.

Referring to FIGS. 9B and 10A, with respect to the mounting direction A, the protection member 132 is located before the contact portion 112. That is, a forefront surface 132-1 of the protection member 132 in the mounting direction A is located before a forefront surface 112-1 of the contact portion 112 in the mounting direction A. According to the above structure, when the contact portion 112 is located at the second position, the protection member 132 is located at the protruding position. When mounting the toner cartridge 100 in the main body 1 while the contact portion 112 is located at the second position, the protection member 132 first contacts the main body 1 or the connection portion 40 before the contact portion 112 contacts the main body 1 or the connection portion 40. Accordingly, collision between the contact portion 112 and the main body 1 or the connection portion 40 during a mounting operation may be prevented.

The toner cartridge 100 is mounted in the main body 1 as illustrated in FIG. 10A while the contact portion 112 and the protection member 132 are respectively located at the first position and the retreat position. When the knob 120 is rotated in this state, the moving member 130 slides, and the contact portion 112 and the protection member 132 slide together respectively to the second position and the protruding position. An insertion portion 50 into which the protection member 132 is inserted is formed in the main body 1.

Referring to FIG. 10B, the protection member 132 protrudes further than the contact portion 112 in a direction to slide to the protruding position. That is, a front end portion 132*a* of the protection member 132 protrudes further than the front end portion 112*a* of the contact portion 120 in the protruding direction. Although not shown in the drawing, the insertion portion 50 may be closer to the side portion 100-2 of the toner cartridge 100 than the connection portion 40. While the contact portion 112 and the connection portion 40 are not completely aligned, that is, while the toner cartridge 100 is not completely inserted, if the contact portion 112 is inserted into the connection portion 40, the contact portion 112 may collide with the connection portion 40 and be damaged. According to the current embodiment, the protection member 132 may be inserted into the insertion portion 50 before the contact portion 112 is inserted into the connection portion 40, thereby aligning the contact portion 112 and the connection portion 40. Consequently, possibility of damage to the contact portion 112 during insertion into the connection portion 40 may be reduced. When the knob 120 is completely rotated, the contact portion 112 is located at the second position where it is inserted into the connection portion 40, as illustrated in FIG. 10C, and the protection member 132 is located at the protruding position where it is inserted into the insertion portion 50.

When the toner cartridge 100 is to be detached from the main body 1 in a state as illustrated in FIG. 10C, as the contact portion 112 is inserted into the connection portion 40, a force may be applied to the contact portion 112. According to the current embodiment of the present invention, as the protection member 132 is also inserted into the insertion portion 50, the force applied to the contact portion 112 is dispersed via the protection member 132. Accordingly, a possibility of damage to the contact portion 112 may be reduced.

As described above, as the protection member 132 is included, a possibility of damage to the contact portion 112 during a mounting or detaching operation of the toner cartridge 100 may be reduced.

Figure 11:
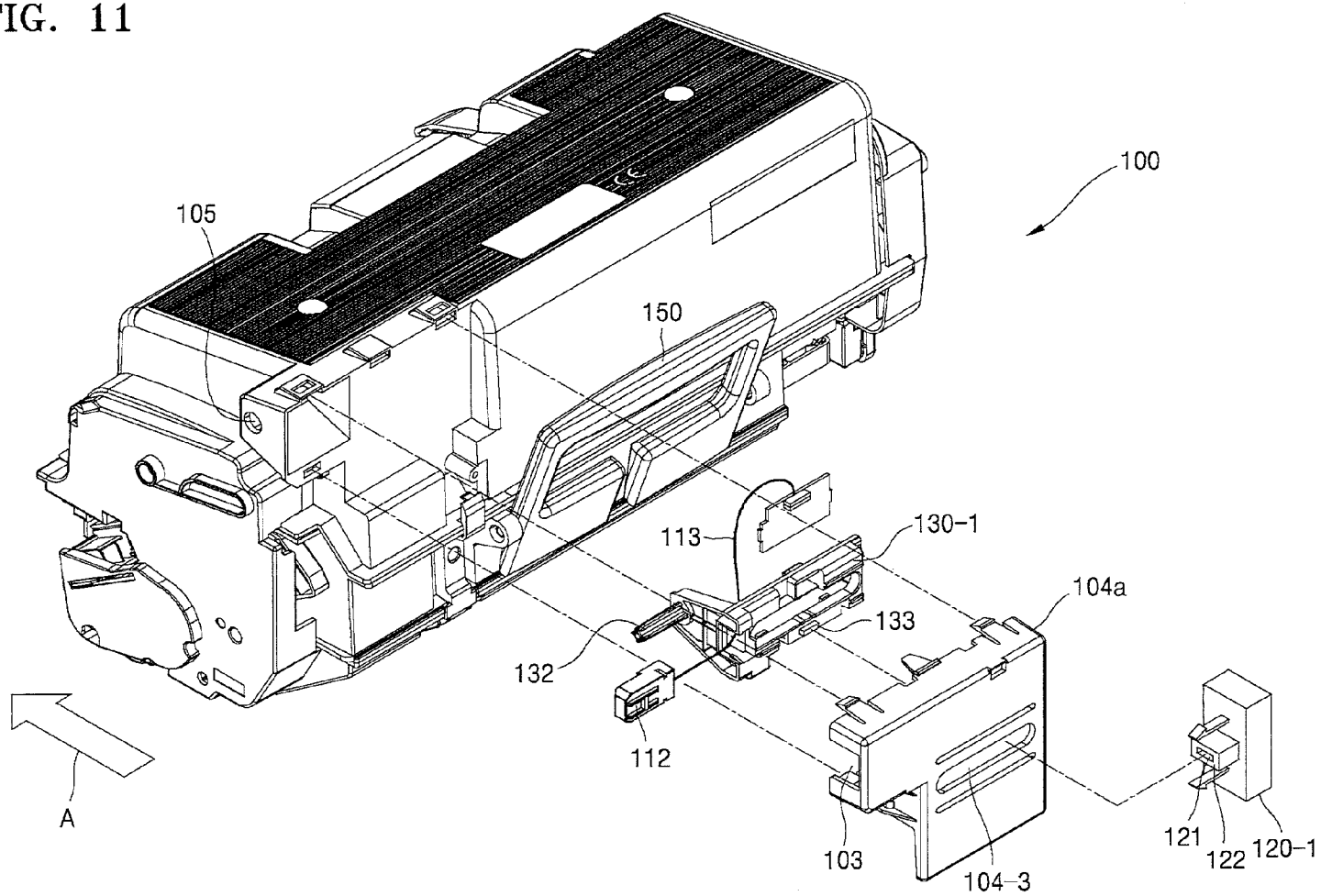
FIG. 11 is an exploded perspective view of a toner cartridge in which a slidable knob is included, according to an embodiment.

While a structure in which the knob 120 that is rotatable is used to move the contact portion 112 to the first or second position is described in the above-described embodiments, the embodiments of the present invention are not limited thereto. A structure in which a knob 120-1 (FIG. 11) that is slidable may also be used to move the contact portion 112 to the first or second position. FIG. 11 is an exploded perspective view of the toner cartridge 100 according to an embodiment of the present invention. The toner cartridge 100 of FIG. 11 is different from the toner cartridge 100 illustrated in FIG. 8 in that the knob 120-1 that is slidable is included.

Referring to FIG. 11, a moving member 130-1 is slidably installed in the toner cartridge 100. For example, the moving member 130-1 is slidably installed in an inner portion of a rear cover 104*a*. The contact portion 112 is fixed to the moving member 130-1 and is connected to the circuit unit 111 via the signal line 113. The circuit unit 111 is fixed to the moving member 103-1 and may be moved together with the contact portion 112. The protection member 132 may be integrally formed with the moving member 130-1. A coupling piece 133 protruding toward the rear cover 104*a* is formed on the moving member 130-1. The knob 120-1 includes a coupling portion 122 in which a groove 121 is formed. A slot 104-3 that is formed by cutting such that the knob 120-1 may slide therein is formed in the rear cover 104*a*. The coupling portion 122 is inserted into the slot 104-3 from the outside of the rear cover 104*a*, and the coupling piece 133 is coupled to the groove 121 of the coupling portion 122. According to this structure, by sliding the knob 120-1 along the slot 104-3, the contact portion 112 may be moved to the first or second position. A sliding direction of the knob 120-1 may be the same as a moving direction of the contact portion 112.

Figure 12:
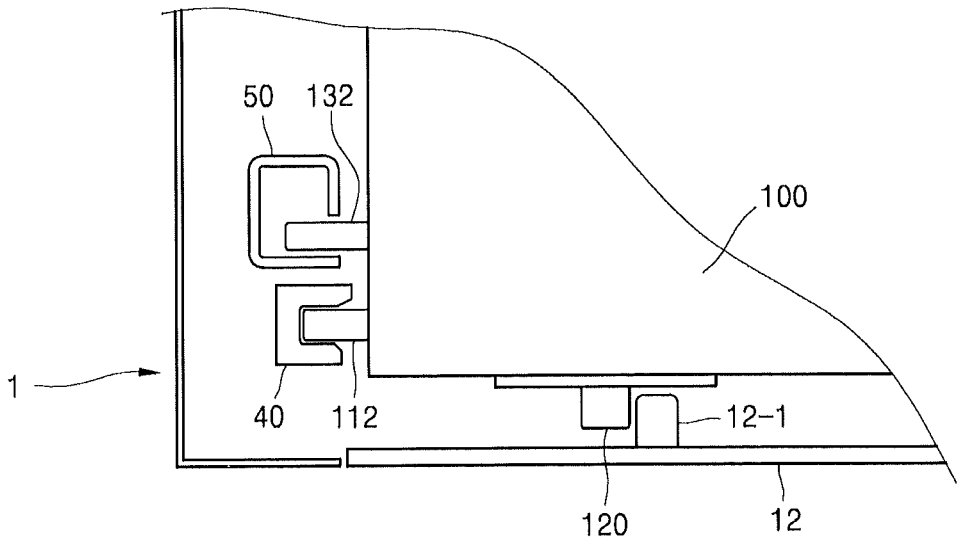
FIG. 12 is a schematic plan view illustrating an image forming apparatus including a connection error prevention structure, according to an embodiment.
Figure 13A:
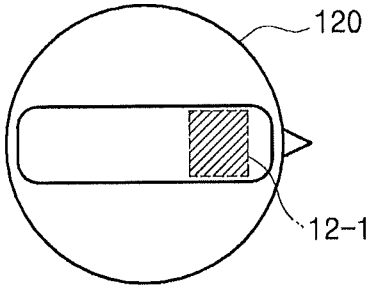
FIGS. 13A and 14A illustrate a position relationship between a knob and an interference portion when a contact portion is located at a first position.
Figure 13B:
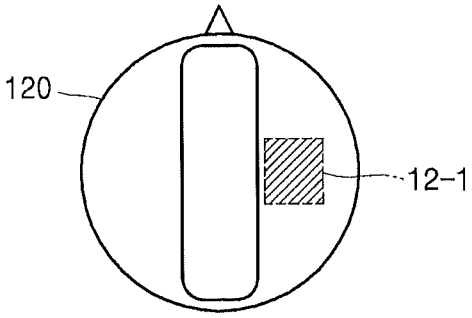
FIGS. 13B and 14B illustrate a position relationship between a knob and an interference portion when a contact portion is located at a second position.

As described above, after mounting the toner cartridge 100 in the main body 1, the knob 120 or 120-1 is manipulated to move the contact portion 112 to the second position to thereby connect the memory unit 110 to the main body 1. Then the door 12 is closed. After mounting the toner cartridge 100 in the main body 1, if the door 12 is closed while the contact portion 112 is not moved to the second position, the memory unit 110 and the main body 1 are not connected. According to the image forming apparatus of the current embodiment of the present invention, the door 12 is not closed unless the contact portion 112 is converted to the second position, thereby preventing a connection error between the toner cartridge 100 and the main body 1. In order to prevent a connection error, for example, interference between the knob 120 or 120-1 and the door 12 may be used. FIG. 12 is a schematic plan view illustrating an image forming apparatus including a connection error prevention structure, according to an embodiment of the present invention. FIG. 13A illustrates a position relationship between the knob 120 and an interference portion 12-1 when the contact portion 112 is located at the first position. FIG. 13B illustrates a position relationship between the knob 120 and the interference portion 12-1 when the contact portion 112 is located at the second position. Referring to FIG. 12, the interference portion 12-1 protruding toward the knob 120 is formed on the door 12. When the contact portion 112 is located at the first position, the knob 120 is located at a position where the knob 120 interferes with the interference portion 12-1 as illustrated in FIG. 13A. Also, when the contact portion 112 is located at the second position, the knob 120 is located at a position where the knob 120 does not interfere with the interference portion 12-1 as illustrated in FIG. 13B. Accordingly, if the door 12 is closed while the toner cartridge 100 is mounted in the main body 1 and the contact portion 112 is located at the first position, the interference portion 12-1 interferes with the knob 120 so that the door 12 is not closed.

Figure 14A:
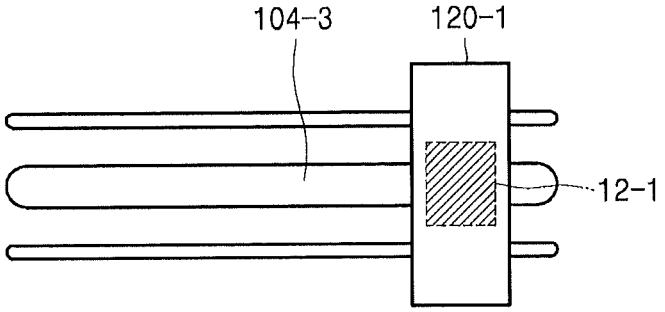
Figure 14B:
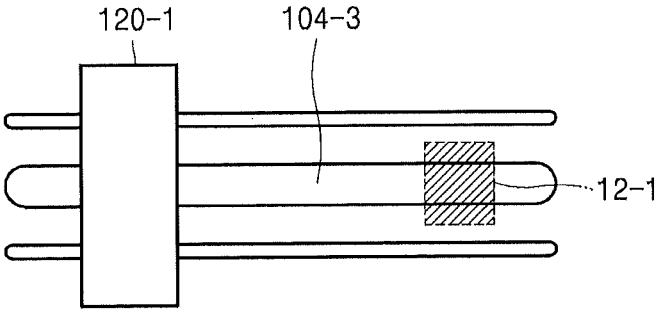

The structures illustrated in FIGS. 12, 13A, and 13B may also be applied to the toner cartridge 100 including the knob 120-1 that is slidable, as illustrated in FIG. 11. For example, when the contact portion 112 is located at the first position, the interference portion 12-1 interferes with the knob 120-1 as illustrated in FIG. 14A, and when the contact portion 112 is located at the second position, the knob 120-1 is located at a position where the knob 120-1 does not interfere with the interference portion 12-1 as illustrated in FIG. 14B.

Figure 15A:
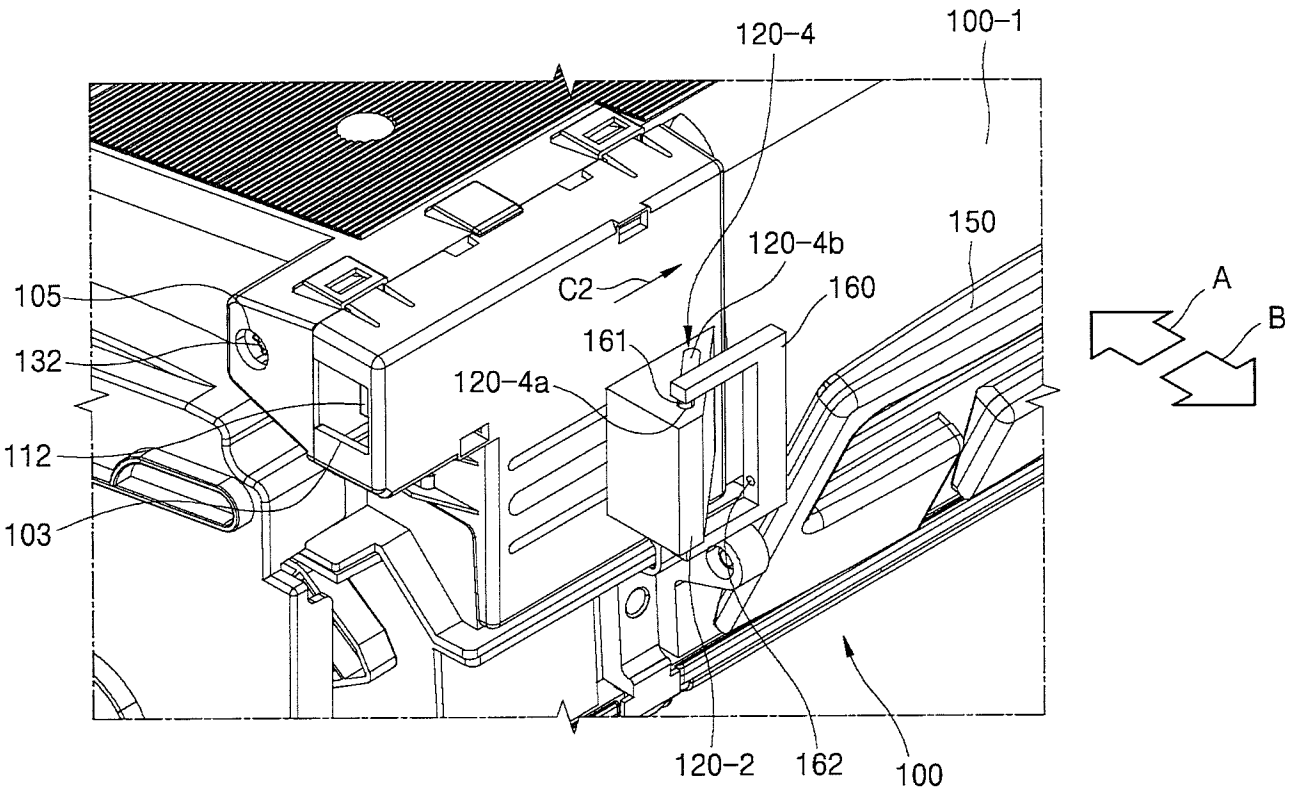
FIGS. 15A and 15B are schematic perspective views illustrating a toner cartridge having a structure in which a contact portion is moved to first or second position in connection with a handle, according to an embodiment.
Figure 15B:
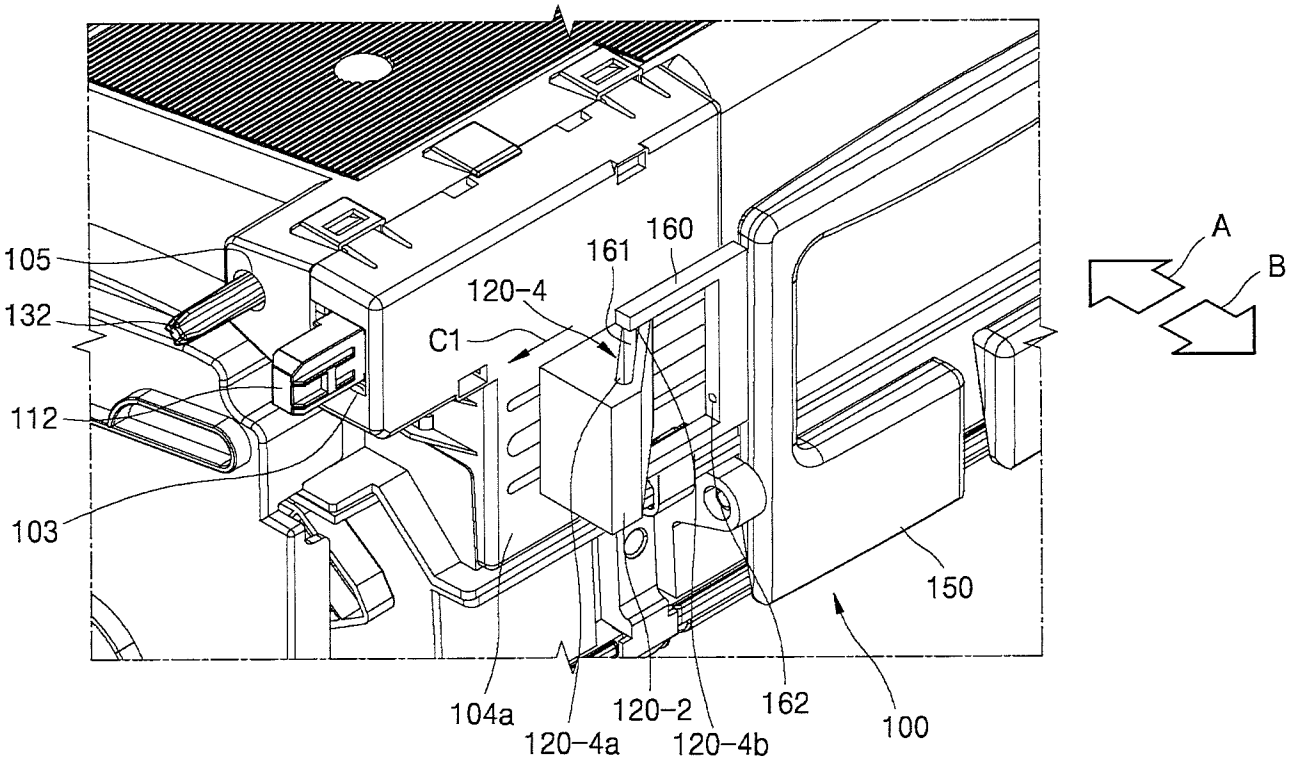

The handle 150 may be formed at the toner cartridge 100 for a user to hold during an attaching or detaching operation of the toner cartridge 100 to or from the main body 1. The contact portion 112 may be moved to the first or second position in connection with the handle 150. FIGS. 15A and 15B are schematic perspective views illustrating the toner cartridge 100 having a structure in which the contact portion 112 is moved to the first or second position in connection with the handle 150, according to an embodiment. The structures for moving the contact portion 112 and the protection member 132 illustrated in FIGS. 15A and 15B are the same as the structure illustrated in FIG. 11. That is, as illustrated in FIG. 11, the contact portion 112 is installed at the moving member 130-1, and the protection member 132 is integrally formed with the moving member 130-1. A knob 120-2 is the same as the knob 120-1 illustrated in FIG. 11 except that the knob 120-2 includes an inclination guide groove 120-4.

Referring to FIGS. 15A and 15B, the handle 150 is pivotably installed at the rear portion 100-1 of the toner cartridge 100. The handle 150 may be disposed, for example, at a holding position protruding from the toner cartridge 100 to hold the toner cartridge 100 as illustrated in FIG. 15A, and may be pivoted from the holding position to an accommodation position that is close to the toner cartridge 100 as illustrated in FIG. 15B. A pivoting direction of the handle 150 may be, for example, the mounting direction A of the toner cartridge 100. A pivoting movement of the handle 150 is converted into sliding movement of the moving member 130-1 by using a conversion unit. The conversion unit may be formed of, for example, the inclination guide groove 120-4 formed in the moving member 130-1 and a connection member 160 that connects the inclination guide groove 120-4 and the handle 150. The inclination guide groove 120-4 is inclined with respect to a moving direction of the contact portion 112 and may be formed in the knob 120-2. A guide post 161 that is inserted into the inclination guide groove 120-4 is formed at a first end of the connection member 160. A second end of the connection member 160 is connected to the handle 150. As the handle 150 is pivotably installed in the toner cartridge 100 in the mounting direction A, the connection member 160 and the handle 150 are pivotably connected to each other with respect to a pivot shaft 162 extending in the moving direction of the contact portion 112.

In order to mount the toner cartridge 100 in the main body 1, the handle 150 is pulled in an opposite direction to the mounting direction A, that is, in a detaching direction B as illustrated in FIG. 15A so as to locate the handle 150 at a holding position that is separated from the rear portion 100-1 of the toner cartridge 100. When the handle 150 pivots, the connection member 160 follows the handle 150 and is moved in a direction away from the rear portion 100-1 of the toner cartridge 100, that is, in the detaching direction B. The guide post 161 is disposed at a first end portion 120-4*a* of the inclination guide groove 120-4, and the contact portion 112 and the protection member 132 are respectively located at the first position and the retreat position which are hidden inside the toner cartridge 100. In this state, the user puts a hand into space between the rear portion 100-1 of the toner cartridge 100 and the handle 150 to lift the toner cartridge 100. The handle 150 is maintained at a position separated from the rear portion 100-1 of the toner cartridge 100, and the contact portion 112 and the protection member 132 are respectively maintained at the first position and the retreat position.

Next, the door 12 is opened to insert the toner cartridge 100 into the main body 1 through the opening portion 11 along the guide rail 100-30 (FIG. 1) formed on the main body 1.

When insertion is completed, the handle 150 is pushed in the mounting direction A to pivot the handle 150 toward the rear portion 100-1 of the toner cartridge 100. Then the connection member 160 is moved toward the rear portion 100-1 of the toner cartridge 100, and the guide post 161 pushes an inner wall of the inclination guide groove 120-4. Due to this pushing force, the knob 120-2 and the moving member 130-1 slide in a direction C1 in which the contact portion 112 is moved to the second position. When the handle 150 reaches an accommodation position, the guide post 161 reaches a second end portion 120-4*b* of the inclination guide groove 120-4, and the contact portion 112 and the protection member 132 are respectively located at the second position and the protruding position as illustrated in FIG. 15B.

When detaching the toner cartridge 100 from the main body 1, the door 12 is opened to pull the handle 150 in the detaching direction B and locate the same at a holding position. Then the connection member 160 is moved in a direction away from the rear portion 100-1 of the toner cartridge 100, and in this operation, the guide post 161 is moved from the second end portion 120-4*b* to the first end portion 120-4*a* while pulling the inner wall of the inclination guide groove 120-4. Accordingly, the knob 120-2 and the moving member 130-1 are slid in a direction C2 in which the contact portion 112 is moved to the first position. When the handle 150 reaches the holding position, as illustrated in FIG. 15A, the contact portion 112 and the protection member 132 are respectively returned to the first position and the retreat position. In this state, the user puts a hand into space between the toner cartridge 100 and the handle 150 to hold the handle 150 and pull the toner cartridge 100 to thereby detach the toner cartridge 100 from the main body 1.

According to the above structure, by holding the handle 150 and detaching or mounting the toner cartridge 100, the contact portion 112 and the protection member 132 may be respectively moved to the first or second position and the retreat position or protruding position.

Figure 16A:
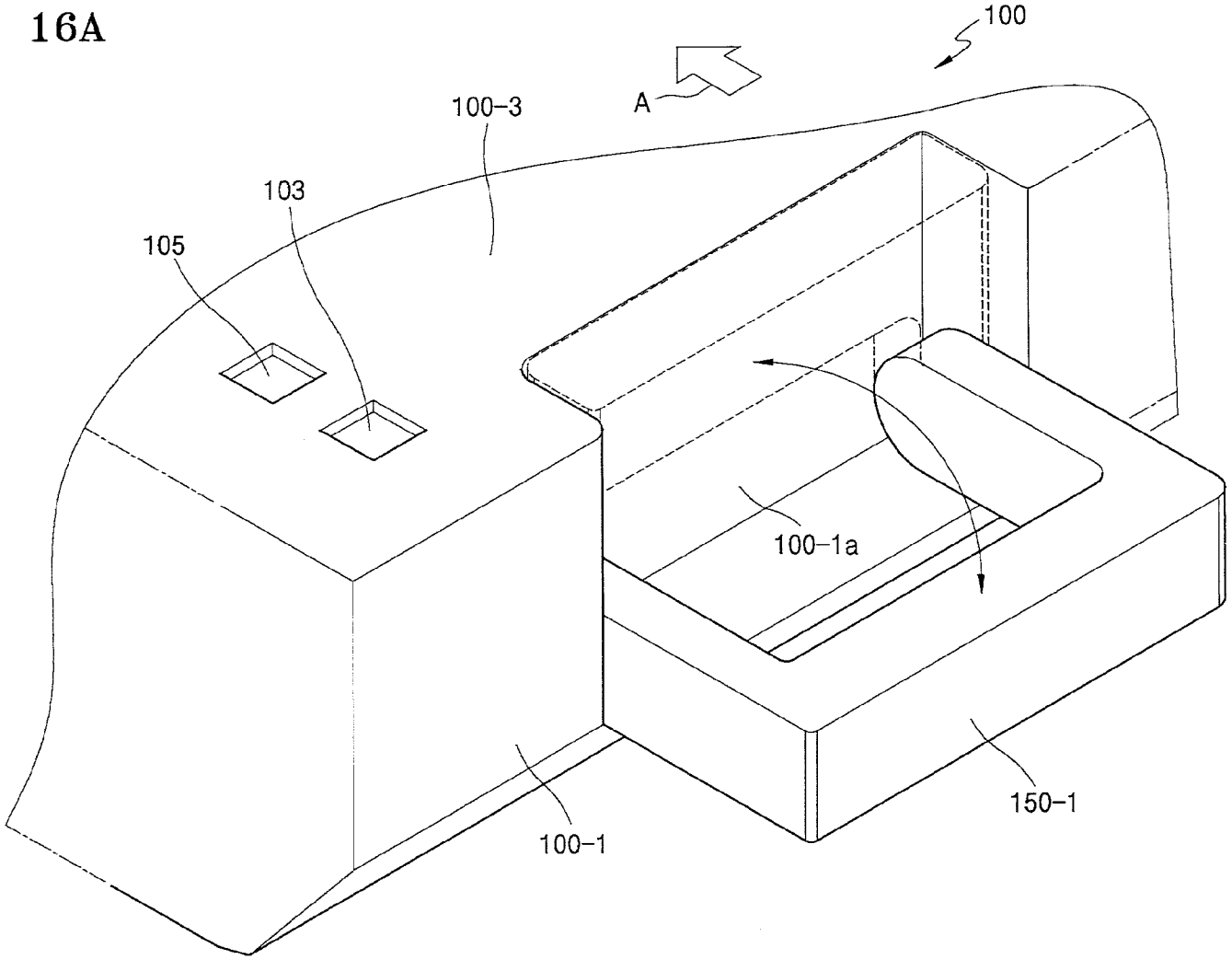
FIG. 16A is a partial perspective view illustrating a toner cartridge according to an embodiment.

FIG. 16A is a partial perspective view illustrating the toner cartridge 100 according to an embodiment. Referring to FIG. 16A, a handle 150-1 is provided in the toner cartridge 100. The handle 150-1 is pivotably installed on the toner cartridge 100. The handle 150-1 may be disposed, for example, at a holding position protruded from the toner cartridge 100 in order to hold the toner cartridge 100 as illustrated by a solid line. Also, the handle 150-1 may pivot from the holding position to a first accommodation position that is close to the toner cartridge 100 as illustrated by a dotted line. An accommodation portion 100-1*a* that is inwardly dented to accommodate the handle 150-1 located at the first accommodation position may be formed in the toner cartridge 100. The handle 150-1 is disposed to face the opening portion 11 so that a user may easily access the handle 150-1 while the toner cartridge 100 is mounted in the main body 1. According to the current embodiment, the handle 150-1 is pivotably installed at the rear portion 100-1 of the toner cartridge 100. Also, the accommodation portion 100-1*a* is inwardly dented in the rear portion 100-1. The contact portion 112 may be moved to the first or second position in connection with pivoting of the handle 150-1 to the holding position and the first accommodation position.

Figure 16B:
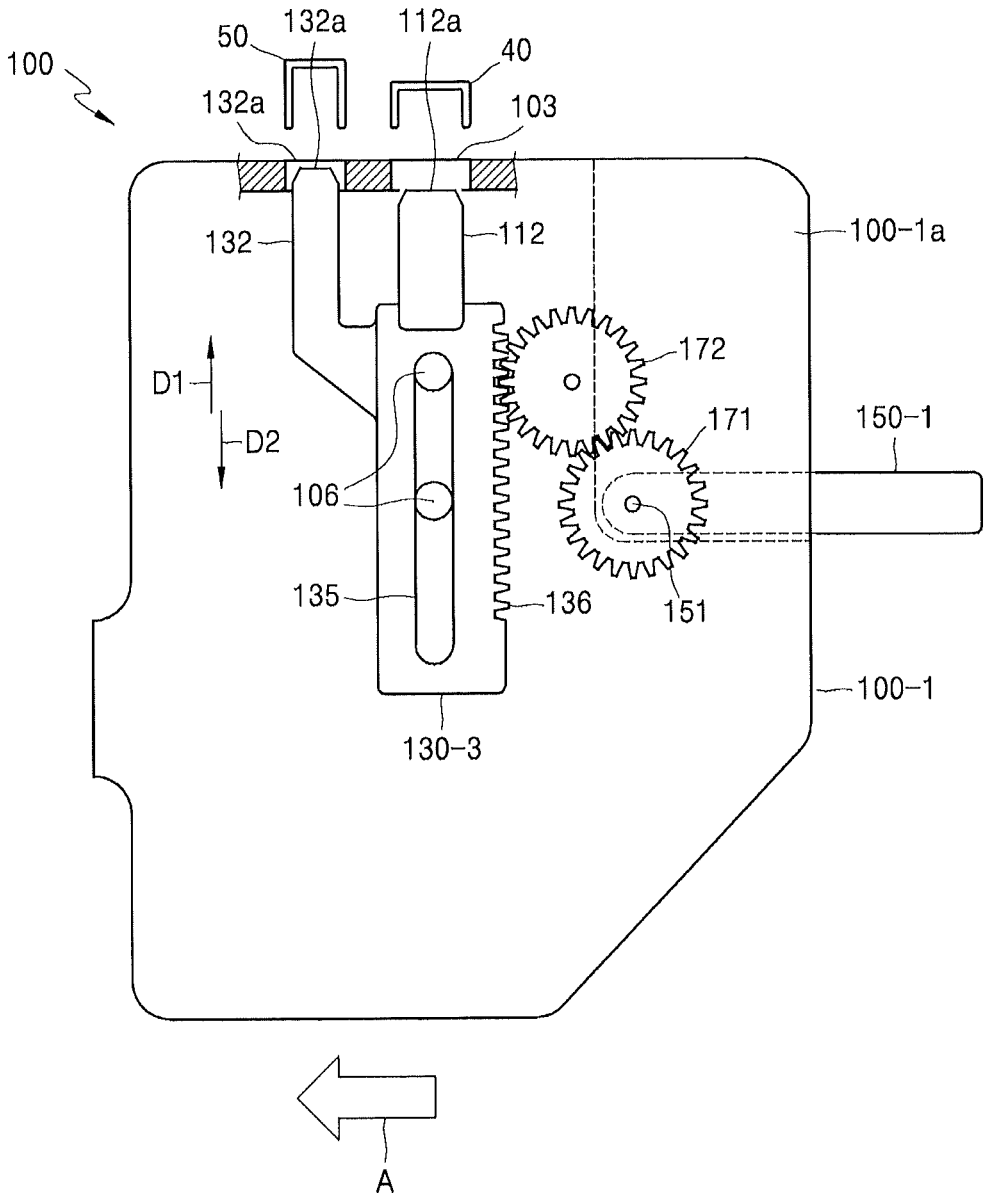
FIG. 16B is a schematic lateral structural diagram of the toner cartridge having a structure in which a contact portion is moved to first or second position in connection with a handle, wherein the handle is located at a holding position.
Figure 16C:
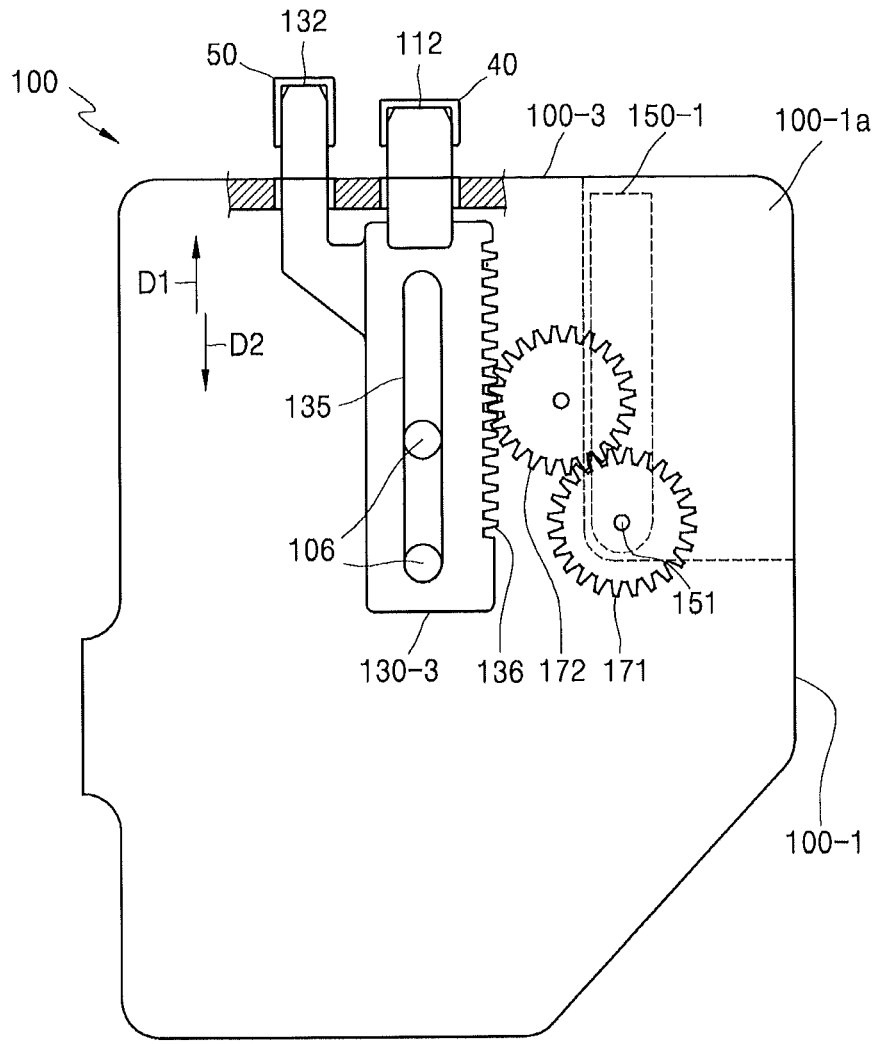
FIG. 16C is a schematic lateral structural diagram of the toner cartridge having a structure in which a contact portion is moved to first or second position in connection with a handle, wherein the handle is located at a first accommodation position.

FIGS. 16B and 16C are schematic lateral structural diagrams of a structure in which the contact portion 112 is moved to the first or second position in connection with the handle 150-1, wherein the handle 150-1 is located at the holding position and the first accommodation position. According to the current embodiment, the contact portion 112 is moved in a height direction of the toner cartridge 100 that is orthogonal to the mounting direction A so that the contact portion 112 is located at the second position protruding from the upper portion 100-3 of the toner cartridge 100.

Referring to FIGS. 16B and 16C, the moving member 130-3 is slidably installed in the toner cartridge 100 in a vertical direction. For example, guide pins 106 that are vertically separated are disposed in the toner cartridge 100, and a guide slot 135 that is formed by cutting in a vertical direction such that the guide pin 106 may be inserted into the guide slot 135 may be formed. The contact portion 112 is mounted in the moving member 130-3. A first outlet 103 through which the contact portion 112 moves in and out is formed on the upper portion 100-3 of the toner cartridge 100. The protection member 132 may be integrally formed with the moving member 130-3, and a second outlet 105 through which the protection member 112 moves in and out may be further formed in the upper portion 100-3 of the toner cartridge 100. The connection portion 40 and the insertion portion 50 are disposed above the toner cartridge 100.

The toner cartridge 100 includes a conversion unit that converts pivoting of the handle 150-1 into sliding movement of the moving member 130-3. The conversion unit may be formed of, for example, a pinion-rack gear structure. The conversion unit may include at least one pinion, here, pinions 171 and 172, and a rack gear 136 that is formed in the moving member 130-3 and is engaged with the pinion 172. While two pinions, the pinions 171 and 172, are used in the current embodiment, the embodiments are not limited thereby. The number of pinions is set in consideration of a pivoting direction of the handle 150-1 so that the contact portion 112 is respectively located at the first position and the second position when the handle 150-1 is located at the holding position and the first accommodation position. For example, according to the embodiment illustrated in FIGS. 16A through 16C, the handle 150-1 pivots anti-clockwise to be converted from the holding position to the first accommodation position. However, alternatively, the handle 150-1 may also pivot clockwise to be converted from the holding position to the first accommodation position. In this case, the pinion 172 is not necessary, and it is sufficient when the pinion 171 and the rack gear 136 engage with each other. That is, the number of pinions may be an even number or an odd number in consideration of a pivoting direction of the handle 150-1 and a sliding direction of the moving member 130-3.

In order to mount the toner cartridge 100 in the main body 1, as illustrated in FIG. 16B, the handle 150-1 which is at the holding position is held to insert the toner cartridge 100 into the main body 1 through the opening portion 11 along the guide rail 30 (FIG. 3B) formed on the main body 1. While the handle 150-1 is located at the holding position, the contact portion 112 and the protection member 132 are respectively located at the first position and the retreat position.

When insertion is completed, the handle 150-1 is pivoted to the first accommodation position. Then the pinions 171 and 172 connected to the pivot shaft 151 are also rotated, and rotation of the pinions 171 and 172 is converted into sliding movement via the rack gear 136 and the moving member 130-3 slides in a direction D1. The contact portion 112 is protruded from the upper portion 100-3 of the toner cartridge 100 via the first outlet 103 and is moved to the connection portion 40. The protection member 132 protrudes from the upper portion 100-3 of the toner cartridge 100 through the second outlet 105 and is moved to the insertion portion 50.

A front end portion 132*a* of the protection member 132 is located further upwards than the front end portion 112*a* of the contact portion 112, and thus, the protection member 132 is inserted into the insertion portion 50 first so as to align the contact portion 112 and the connection portion 40. Then the contact portion 112 is inserted into the connection portion 40.

As illustrated in FIG. 16C, when the handle 150-1 is located at the first accommodation position, the contact portion 112 and the protection member 132 are respectively located at the second position and the protruding position.

Next, an operation of detaching the toner cartridge 100 from the main body 1 will be described. First, the door 12 is opened. The handle 150-1 is maintained at the first accommodation position as illustrated in FIG. 16C, and the contact portion 112 and the protection member 132 are respectively maintained at the second position and the protruding position. The handle 150-1 is pulled to be pivoted to the holding position. Then the pinions 171 and 172 connected to the pivot shaft 151 are also rotated, and rotation of the pinions 171 and 172 is converted into sliding movement via the rack gear 136 and the moving member 130-3 slides in a direction D2. When the handle 150-1 is located at the holding position, the contact portion 112 and the protection member 132 respectively return to the first position and the retreat position as illustrated in FIG. 16B. In this state, the handle 150-1 is held to pull the toner cartridge 100 to thereby detach the toner cartridge 100 from the main body 1.

When the toner cartridge 100 is separated from the main body 1, if the handle 150-1 is located at the holding position, an external appearance of the toner cartridge 100 is increased. When moving the handle 150-1 to the first accommodation position, the external appearance of the toner cartridge 100 is reduced but the contact portion 112 protrudes and thus the contact portion 112 is likely to be damaged. Considering this, a method of reducing the external appearance of the toner cartridge 100 in the case when the toner cartridge 100 is separated from the main body 1 is required.

Figure 17A:
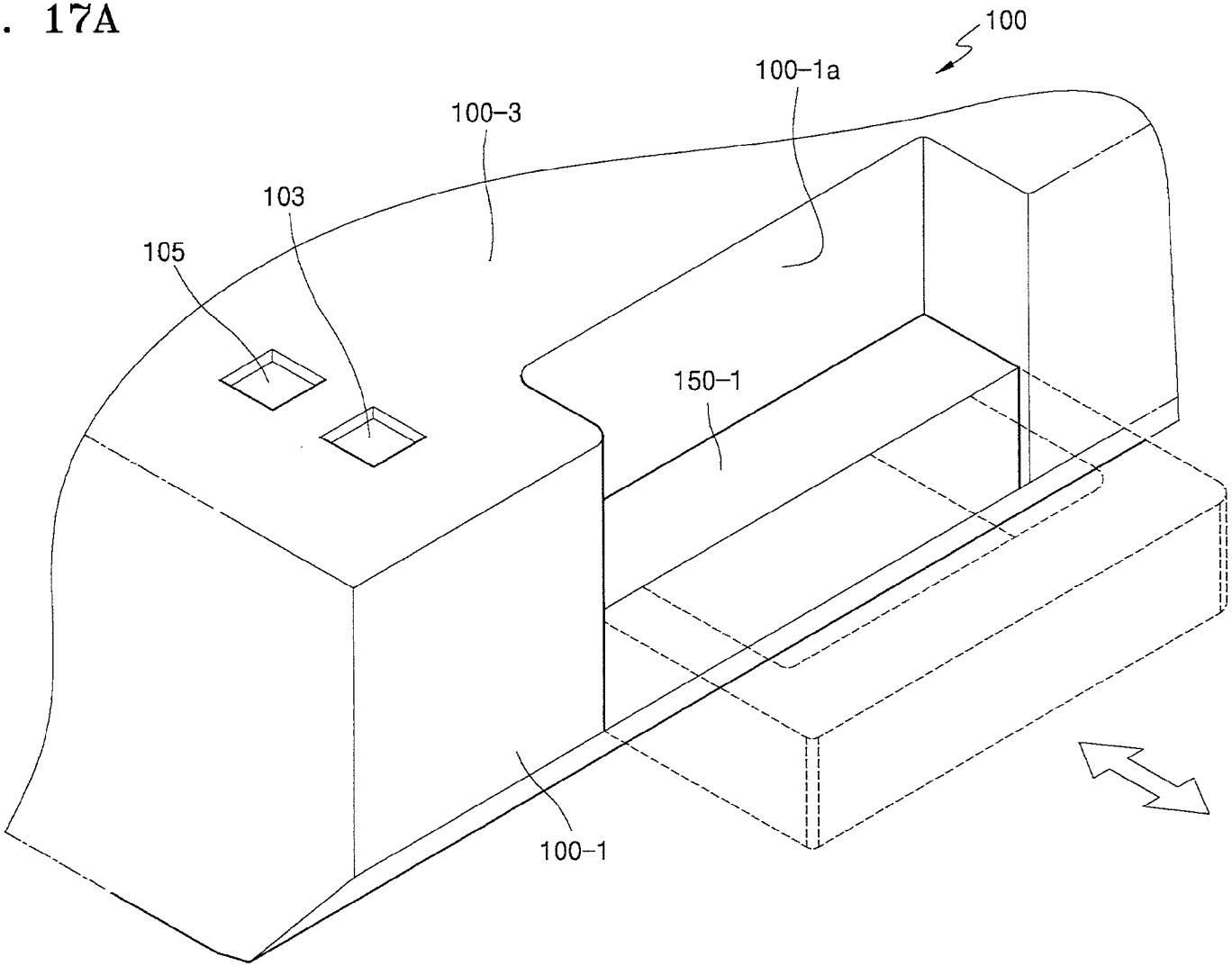
FIG. 17A is a perspective view of a toner cartridge according to an embodiment.
Figure 17B:
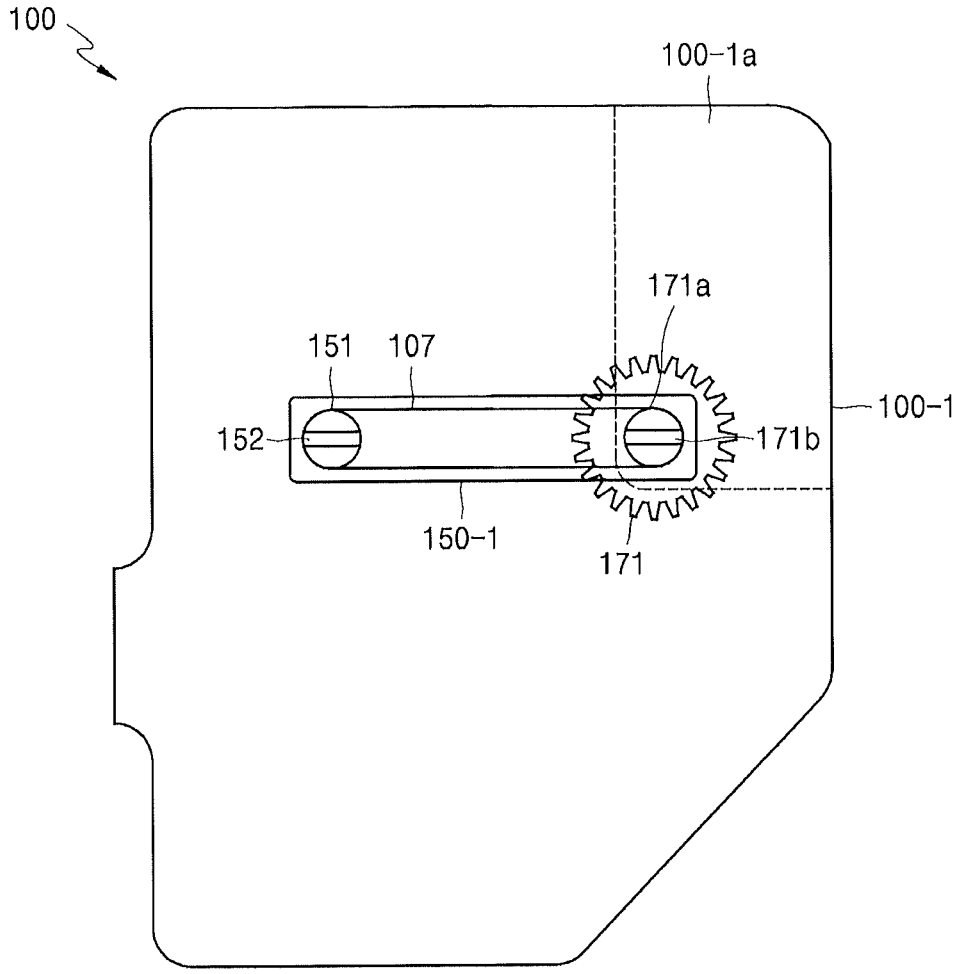
FIG. 17B is a schematic lateral view of the toner cartridge of FIG. 17A, wherein a handle is located at a second accommodation position.
Figure 17C:
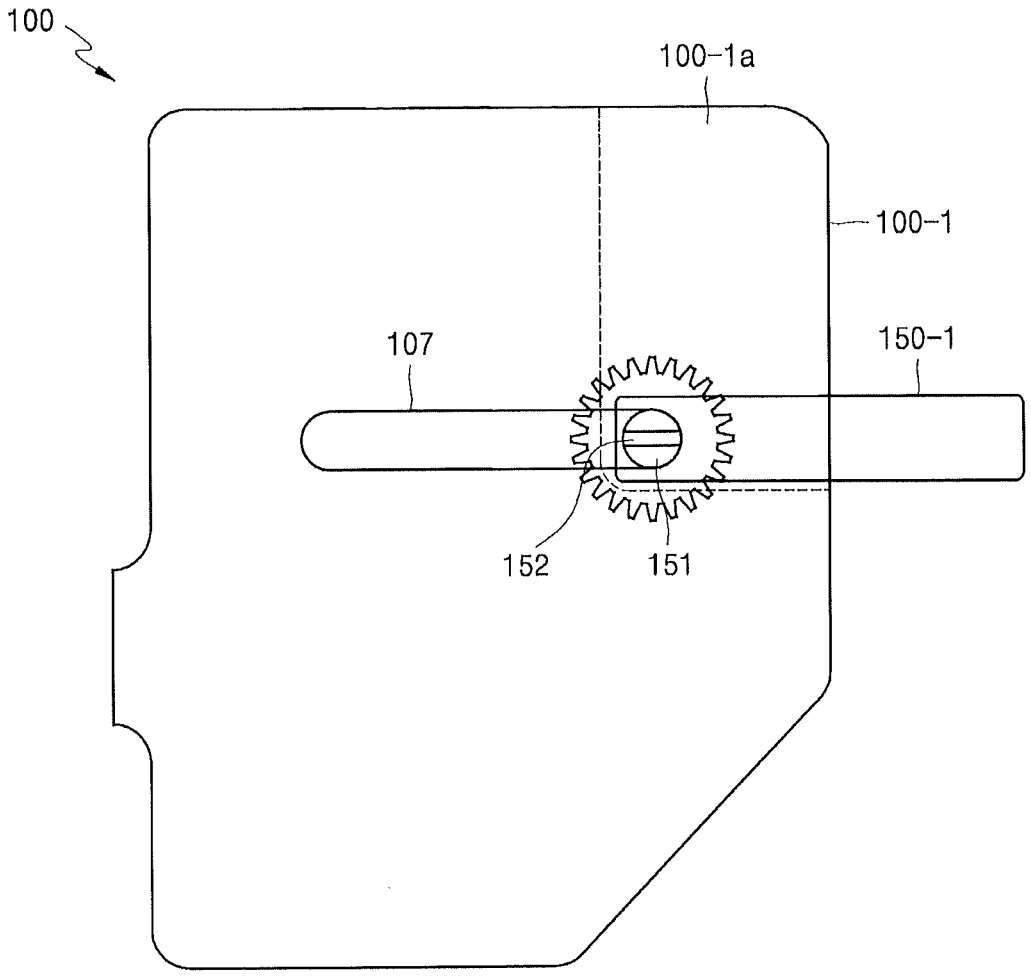
FIG. 17C is a schematic lateral view of the toner cartridge of FIG. 17A, wherein a handle is located at a holding position.
Figure 17D:
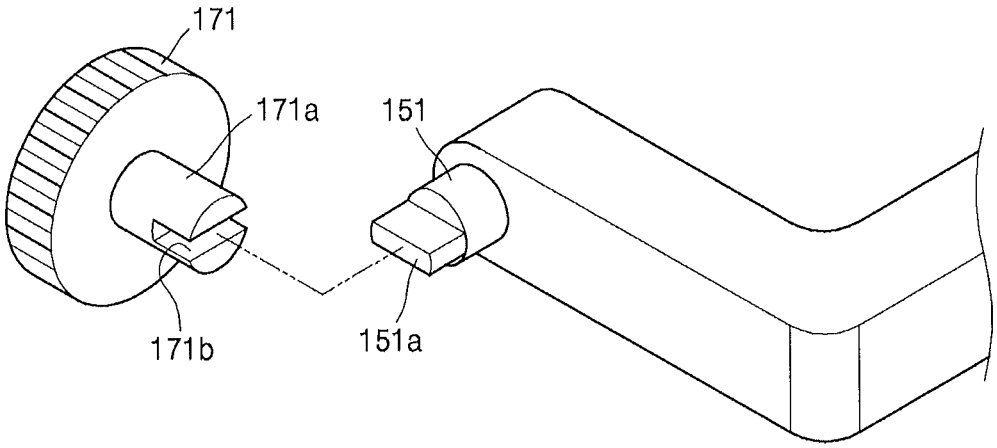
FIG. 17D is an exploded perspective view illustrating a connection relationship between a pivot shaft of a handle and a pinion, according to an embodiment.
Figure 17E:
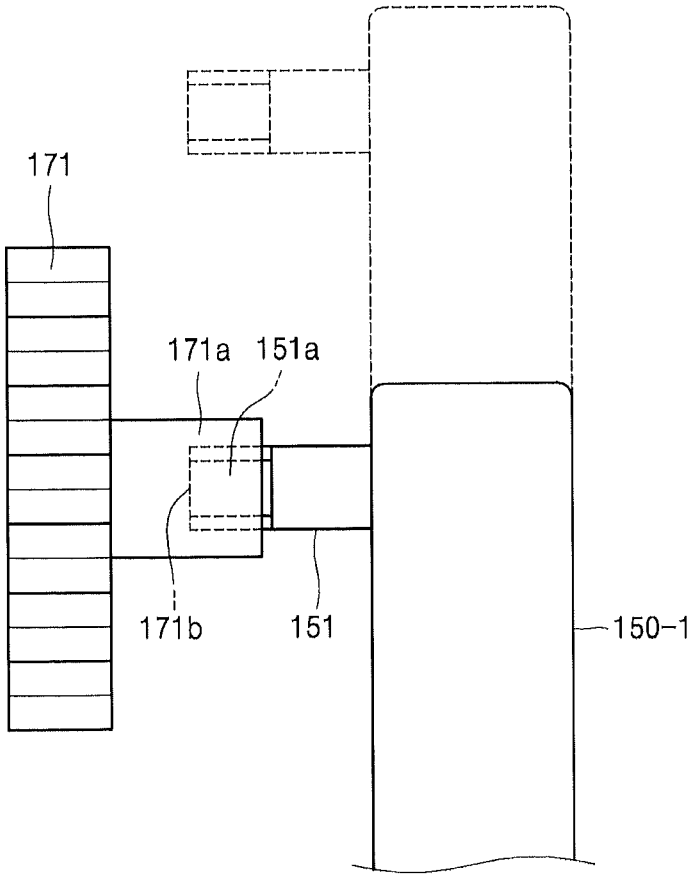
FIG. 17E is a plan view illustrating a connection relationship between a pivot shaft of a handle and a pinion, according to an embodiment.

FIG. 17A is a perspective view of the toner cartridge 100 according to an embodiment, and FIG. 17B is a schematic lateral view of the toner cartridge 100 of FIG. 17A, wherein the handle 150-1 is located at a second accommodation position. FIG. 17C is a schematic lateral view of the toner cartridge 100 of FIG. 17A, wherein the handle 150-1 is located at a holding position. FIGS. 17D and 17E are respectively an exploded perspective view and a plan view illustrating a connection relationship between the pivot shaft 151 of the handle 150-1 and the pinion 171, according to an embodiment of the present invention.

Referring to FIG. 17A, the handle 150-1 is slid to the holding position (illustrated by a dotted line) and the second accommodation position accommodated in the accommodation portion 100-1*a* formed in the rear portion 100-1 of the toner cartridge 100. To this end, referring to FIGS. 17B and 17C, a guide slot 107 is formed in the toner cartridge 100. The pivot shaft 151 is inserted into the guide slot 107 and slides along the guide slot 107. According to the above structure, the handle 150-1 that moves to the holding position and the second accommodation position may be realized.

The toner cartridge 100 illustrated in FIGS. 17A through 17E is identical to the toner cartridge 100 illustrated in FIGS. 16A through 16C except that the handle 150-1 slides to the holding position and the second accommodation position. Accordingly, movement of the contact portion 112 to the first and second position as the handle 150-1 is pivoted to the holding position and the first accommodation position will be described with reference to FIGS. 16A through 16C.

The handle 150-1 may be pivoted from the holding position to the first accommodation position illustrated in FIG. 16A. The pivot shaft 151 of the handle 150-1 is connected to a conversion unit when the handle 150-1 is located at the holding position and the first accommodation position, and is released from the conversion unit when the handle 150-1 is located at the second accommodation position. For example, when the handle 150-1 is located at the second accommodation position, connection between the pinion 171 and the pivot shaft 151 is released, and the pinion 171 and the pivot shaft 151 may be connected to each other when the handle 150-1 is located at the holding position. Accordingly, by moving the handle 150-1 to the holding position and the first accommodation position as illustrated in FIGS. 16B and 16C, the contact portion 112 may be moved to the first or second position. Referring to FIGS. 17D and 17E, first and second coupling portions 151*a* and 171*b* are formed at the pivot shaft 151 and the pinion 171, respectively. The first and second coupling portions 151*a* and 171*b* may have complementary forms such that the pinion 171 may also be pivoted when the handle 150-1 is pivoted. For example, the first coupling portion 151*a* may be in the form of an extension piece extending in a sliding direction of the handle 150-1, and the second coupling portion 171*b* may be in the form of an extension groove that is formed in a central shaft 171*a* of the pinion 171 by cutting such that the extension piece may be inserted thereinto. According to the above structure, as illustrated in FIG. 17E by a dotted line, when the handle 150-1 is located at the second accommodation position, connection between the pivot shaft 151 and the pinion 171 is released, and when the handle 150-1 slides to the holding position, the first coupling portion 151*a* is inserted into the second coupling portion 171*b* so that the pivot shaft 151 and the pinion 171 are connected to each other, and when the handle 150-1 is pivoted to the first accommodation position, the pinion 171 is also rotated.

While being separated from the main body 1, the handle 150-1 is also located at the second accommodation position as illustrated in FIG. 17A by a solid line. In this state, connection between the pivot shaft 151 and the pinion 171 is released. The contact portion 112 and the protection member 132 are respectively located at the first position and the retreat position as illustrated in FIG. 16B.

To mount the toner cartridge 100 in the main body 1, the handle 150-1 is pulled to be slid to the holding position as illustrated in FIG. 17A by a dotted line. When the handle 150-1 reaches the holding position, the first coupling portion 151*a* formed at the pivot shaft 151 is coupled to the second coupling portion 171*b* of the pinion 171 so that the pivot shaft 151 and the pinion 171 are connected to each other. The contact portion 112 and the protection member 132 are respectively maintained at the first position and the retreat position as illustrated in FIG. 16B.

In this state, as described above with reference to FIGS. 16B and 16C, when the toner cartridge 100 is mounted on the main body 1 and the handle 150-1 is pushed to be pivoted to the first accommodation position, the contact portion 112 and the protection member 132 are respectively moved to the second position and the protruding position via pivoting of the handle 150-1, so as to be respectively inserted into the connection portion 40 and the insertion portion 50.

An operation of detaching the toner cartridge 100 is also the same as described with reference to FIGS. 16C and 16B. When detachment of the toner cartridge 100 is completed, the handle 150-1 is pushed to be slid to the second accommodation position. Then the first coupling portion 151*a* formed at the pivot shaft 151 is separated from the second coupling portion 171*b* of the pinion 171, and connection between the pivot shaft 151 and the pinion 171 is released, and the contact portion 112 and the protection member 132 are respectively maintained at the first position and the retreat position. By locating the handle 150-1 at the second accommodation position, the toner cartridge 100 may maintain a small external appearance when being separated from the main body 1. The toner cartridge 100 in the form as described above has a small size in a packed state when it is provided as a consumable, and thus loading costs for transportation may be reduced.

Figure 18:
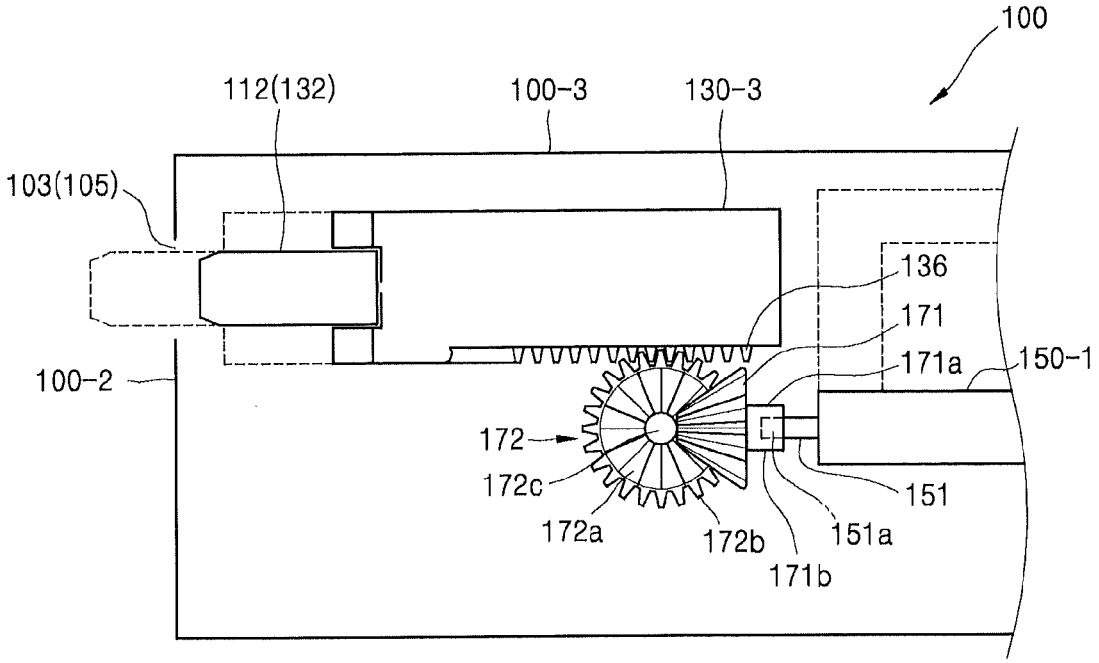
FIG. 18 is a schematic rear view of a toner cartridge according to an embodiment.

The embodiments illustrated in FIGS. 16A through 16C and FIGS. 17A through 17E may be modified to a structure in which the contact portion 112 is protruded from the side portion 100-2 of the toner cartridge 100. FIG. 18 is a schematic rear view of the toner cartridge 100 according to an embodiment. According to the embodiment of FIG. 18, the contact portion 112 is located at the second position protruding from the side portion 100-2 of the toner cartridge 100.

Referring to FIG. 18, the pinion 171 connected to the pivot shaft 151 of the handle 150-1 is a bevel gear. The pinion 172 connected to the pinion 171 includes a bevel gear 172*a* and a spur gear 171*b*. The bevel gear 172*a* and the spur gear 171*b* have a common rotation shaft 172*c*, and are separated from each other in a direction to the rotation shaft 172*c*. The pinion 171 and the pinion 172 have rotation shafts that are orthogonal to each other. According to the above structure, the pinion 171, the bevel gear 172*a*, the spur gear 171*b*, and the rack gear 136 are sequentially connected, and via rotation of the handle 150-1 from the holding position to the first accommodation position (illustrated by a dotted line of FIG. 18), the moving member 130-3 may be slid so that the contact portion 112 and the protection member 132 are respectively located at the second position and the protruding position protruding from the side portion 100-2 of the toner cartridge 100. While not illustrated in the drawing, the moving member 130-3 may also slide in a direction in which the contact portion 112 and the protection member 132 are protruded from a front portion 100-4 of the toner cartridge 100 according to an arrangement angle of the pinion 171, which is in the form of a bevel gear, and the bevel gear 172*a*.

The embodiments in which the contact portion 112 is moved to the first or second position in connection with manipulation of a knob or manipulation of the handle by the user to detach the cartridge are described above, but the embodiments are not limited thereto.

The contact portion 112 may also be moved to the first or second position via opening or closing of the door 12. For example, the knob 120-1 illustrated in FIG. 11 may be slid via an operation of closing and/or opening the door 12 to move the contact portion 112 to the second position and/or the first position. The handle 150 illustrated in FIGS. 15A and 15B is pivoted via the operation of closing and/or opening the door 12 to slide the knob 120-2 to move the contact portion 112 to the second position and/or the first position. The handle 150-1 illustrated in FIGS. 16A and 17A is pivoted via an operation of closing the door 12 to rotate the pinion 171, thereby moving the contact portion 112 to the second position.

The contact portion 112 may also be moved to the first or second position via an operation of mounting a cartridge to the main body 1. For example, the moving members described above may be moved in connection with an operation member (not shown) formed on the main body 1 when mounting a cartridge on the main body 1, and the contact portion 112 may be moved to the second position accordingly. In contrast, when the cartridge is detached from the main body 1, the contact portion 112 may return to the first position.

According to the above-described embodiment, the contact portion 112 is moved to the first or second position. Alternatively, the contact portion 112 may be disposed at a fixed position and instead the connection portion 40 may be moved.

Figure 19A:
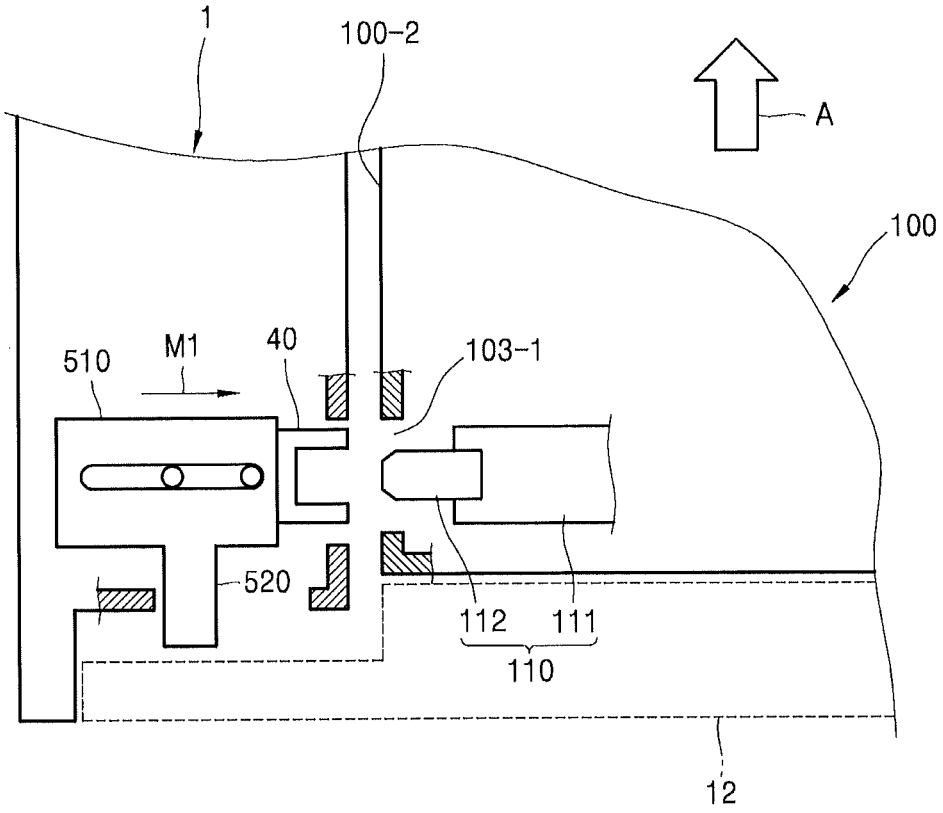
FIG. 19A is a schematic plan view of a movement structure of a connection portion according to an embodiment, wherein the connection portion is located at a release position released from a contact portion.
Figure 19B:
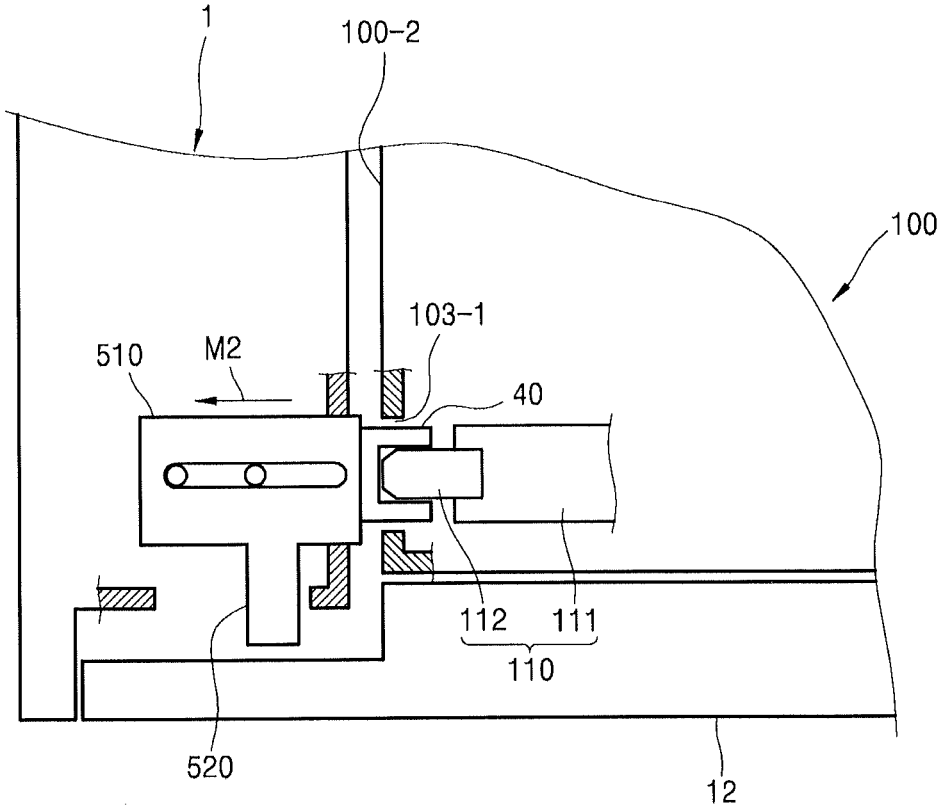
FIG. 19B is a schematic plan view of a movement structure of a connection portion according to an embodiment, wherein the connection portion is located at a connection position connected to the contact portion.

FIGS. 19A and 19B are schematic plan views of a movement structure of the connection portion 40 according to an embodiment. FIG. 19A is a plan view illustrating the connection portion 40 located at a release position released from the contact portion 112, and FIG. 19B is a plan view illustrating the connection portion 40 located at a connection position connected to the contact portion 112. Referring to FIGS. 19A and 19B, the contact portion 112 is located in the toner cartridge 100. The contact portion 112 may be disposed not to be exposed out of the toner cartridge 100. An exit 103-1 through which the connection portion 40 goes in and out may be formed, for example, at the side portion 100-2 of the toner cartridge 100. A moving member 510 is movably installed in the main body 1 in a direction orthogonal to the mounting direction A, for example, in a width direction of the toner cartridge 100. The connection portion 40 is mounted on the moving member 510. The moving member 510 is moved to the connection position where the connection portion 40 is connected to the contact portion 112 and the release position where the connection portion 40 is released from the contact portion 112. To this end, the moving member 510 includes a knob 520. As illustrated in FIG. 19A, while the door 12 is opened, the toner cartridge 100 is mounted in the main body 1. Here, the connection portion 40 is located at the release position. After mounting the toner cartridge 100, the user holds the knob 520 to move the moving member 510 in a direction M1. Then, the connection portion 40 approaches the contact portion 112 disposed inside the toner cartridge 100 through the exit 103-1, and is located at the connection position connected to the contact portion 112 as illustrated in FIG. 19B. To detach the toner cartridge 100, the door 12 is opened in a state as illustrated in FIG. 19B, and the moving member 510 is moved in a direction M2. Then the connection portion 40 is released from the contact portion 112 to be moved to the release position as illustrated in FIG. 19A. According to the above structure, the connection portion 40 may be moved to the connection position and the release position via manipulation by the user.

Although the protection member 132 and the insertion portion 50 are not illustrated in FIGS. 19A and 19B, the protection member 132 may be integrally formed with the moving member 510, and the insertion portion 50, into which the protection member 132 is inserted, may be formed in the toner cartridge 100. In this case, the protection member 132 may be inserted into the insertion portion 50 before the connection portion 40 is connected to the contact portion 112 so as to align the connection portion 40 and the contact portion 112; when the toner cartridge 100 is detached from the main body 1 while the connection portion 40 is not moved to the release position, the protection member 132 and the insertion portion 50 may perform the function of dispersing an impact applied to the connection portion 40 and the contact portion 112 as described above.

Figure 20A:
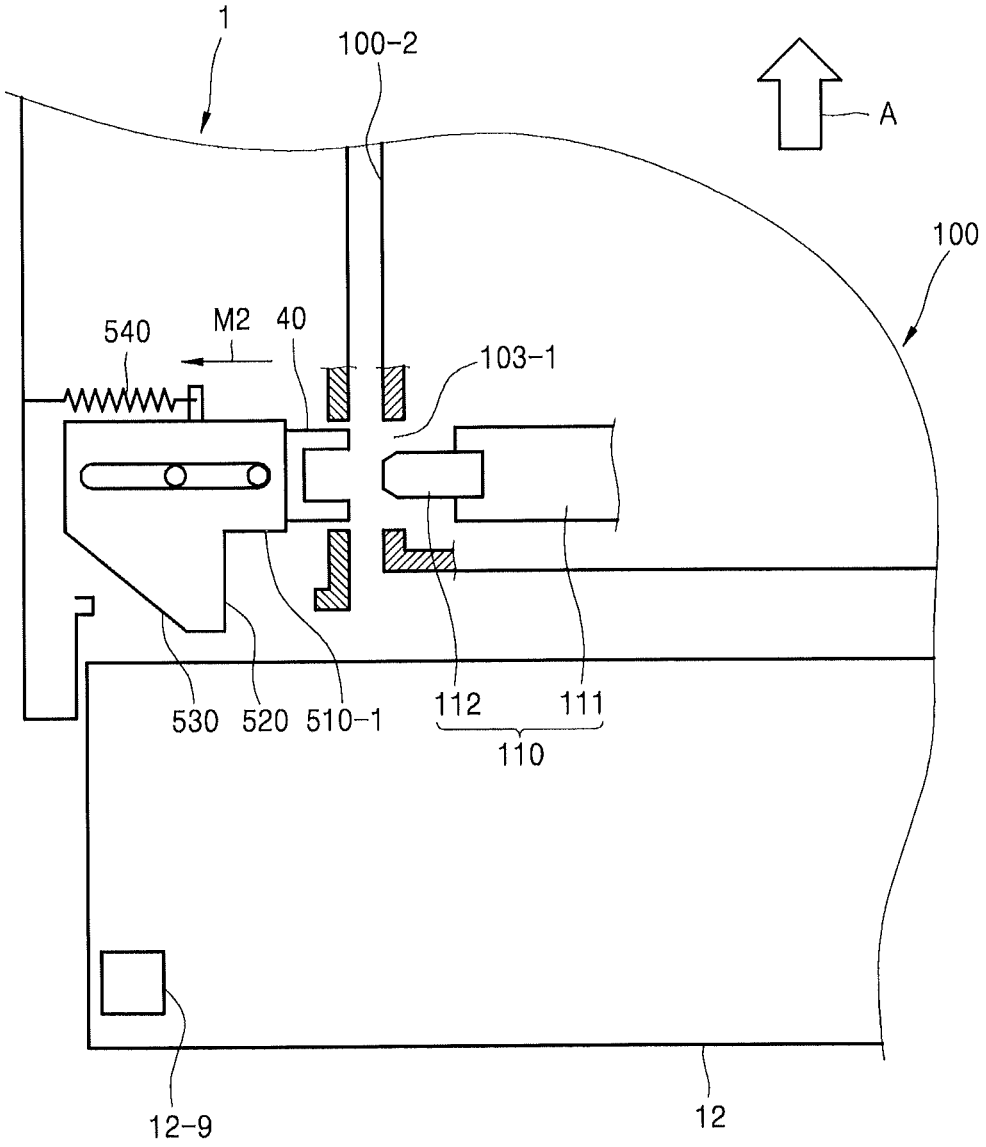
FIG. 20A is a schematic view of a structure in which a connection portion is moved to a connection position via a closing operation of a door according to an embodiment, wherein the connection portion is located at a release position released from a contact portion.
Figure 20B:
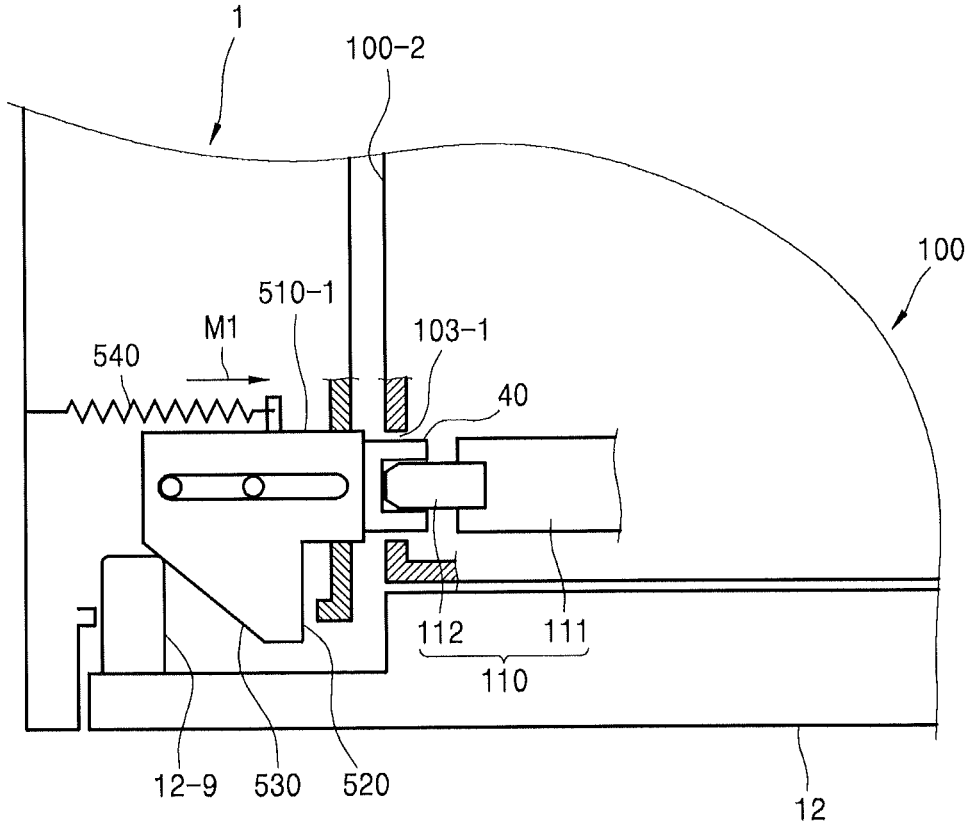
FIG. 20B is a schematic view of a structure in which a connection portion is moved to a connection portion via a closing operation of a door according to an embodiment, wherein the connection portion is located at a connection position connected to the contact portion.

The connection portion 40 may also be moved to a connection position via an operation of closing the door 12. FIGS. 20A and 20B are schematic plan views of a structure of the connection portion 40 in connection with a closing operation of the door 12, according to an embodiment. FIG. 20A is a plan view illustrating the connection portion 40 located at a release position released from the contact portion 112, and FIG. 20B is a plan view illustrating the connection portion 40 located at a connection position connected to the contact portion 112. Referring to FIGS. 20A and 20B, a moving member 510-1 is different from the moving member 510 illustrated in FIGS. 19A and 19B in that an inclination portion 530 inclined with respect to a moving direction of the moving member 510-1 is further included. A push lever 12-9 that pushes the inclination portion 530 by being in contacts with the inclination portion 530 when the door 12 is closed is formed on the door 12. According to the above structure, when the door 12 is closed after the toner cartridge 100 is mounted in the main body 1, the push lever 12-9 pushes the inclination portion 530. Then the moving member 510-1 is moved in the direction M1 as illustrated in FIG. 20B, and the connection portion 40 is moved to the connection position connected to the contact portion 112. An elastic member 540 applies an elastic force to the moving member 510-1 so that the connection portion 40 is moved in a direction to be located at the release position. Upon opening the door 12 to detach the toner cartridge 100 from the main body 1, the moving member 510-1 is moved in the direction M2 via the elastic force of the elastic member 540 as illustrated in FIG. 20A, and the connection portion 40 returns to the release position released from the contact portion 112. If the elastic member 540 is not present, the door 12 may be opened and the moving member 510-1 may be moved in the direction M2 by using the knob 520, and then the toner cartridge 100 may be detached from the main body 1.

Above described are the embodiments in which the contact portion 112 of the memory unit 110 installed in the toner cartridge 100 is moved to the first or second position in a structure where the toner cartridge 100 is separately replaced from the image cartridge 400, but the embodiments of the present invention are not limited thereto.

The structure in which the contact portion 112 is moved to the first or second position may also be applied to the process cartridge 2 having the third structure in which the development cartridge 300 including the toner containing unit 101 is separately replaced from the photoconductor cartridge 200. In this case, the toner cartridge 100 is replaced by the development cartridge 300 in the above-described embodiments. When the development cartridge 300 is mounted in the main body 1, the memory unit 110 is electrically connected to the main body 1 to transmit information of the development cartridge 300 to the main body 1. The memory unit 110 may store various types of information of the development cartridge 300, for example, specific information such as manufacturer information, manufacture date information, a serial number, or a model number, various programs, electronic signature information, and usage state (for example, a number of pages printed so far, a number of remaining printable pages, or an amount of toner left), and even the lifetime and set up menus of the development cartridge 300.

Also, the structure in which the contact portion 112 is moved to the first or second position may be applied to the process cartridge 2 having the fourth structure in which the photoconductor cartridge 200, the development cartridge 300, and the toner cartridge 100 are integrally formed. In this case, the toner cartridge 100 is replaced by the process cartridge 2 in the above-described embodiments. When the process cartridge 2 is mounted in the main body 1, the memory unit 110 is electrically connected to the main body 1 to transmit information of the process cartridge 2 to the main body 1. The memory unit 110 may store various types of information of the process cartridge 2, for example, specific information such as manufacturer information, manufacture date information, a serial number, or a model number, various programs, electronic signature information, and usage state (for example, a number of pages printed so far, a number of remaining printable pages, or an amount of toner left), and even the lifetime and set up menus of the process cartridge 2.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present invention as defined by the following claims.

What is claimed is:

1. A cartridge that is attached to or detached from a main body of an image forming apparatus, the main body including an opening and a door to open/close the opening, the cartridge comprising:

a memory unit that includes a contact portion via which the cartridge is connected to the main body and is connected to the main body to transmit information of the cartridge to the main body, wherein a knob is configured to move the contact portion to a first position where the contact portion is hidden in the cartridge and to a second position where the contact portion protrudes out of the cartridge in order to be connected to a connection portion provided in the main body, wherein the knob contacts an interference portion of the door such that the door is not closed when the contact portion is located at the first position.

2. The cartridge of claim 1, further comprising:

a moving member, on which the contact portion is mounted, wherein the moving member is moved to the first or second position, wherein the knob is connected to the moving member so as to move the moving member.

3. The cartridge of claim 2, further comprising a protection member that is moved, as the contact portion is moved to the first or second position, to a retreat position that is hidden in the cartridge and a protruding position protruding out of the cartridge in order to be inserted into an insertion portion provided in the main body.

4. The cartridge of claim 3, wherein the protection member is inserted into the insertion portion before the contact portion is connected to the connection portion so as to align the contact portion and the connection portion.

5. The cartridge of claim 4, wherein a front end portion of the protection member protrudes further than a front end portion of the contact portion in a moving direction of the contact portion.

6. The cartridge of claim 3, wherein the contact portion is moved in a length direction of the cartridge that is orthogonal to a mounting direction of the cartridge, wherein the protection member is disposed before the contact portion in the mounting direction of the cartridge.

7. The cartridge of claim 3, wherein the protection member is integrally formed with the moving member.

8. The cartridge of claim 2, wherein the knob is formed at a rear portion of the cartridge with respect to a mounting direction of the cartridge.

9. The cartridge of claim 2, wherein the cartridge is attached to or detached from the main body through an opening portion formed in the main body, wherein the knob is installed at a portion of the cartridge facing the opening portion.

10. The cartridge of claim 2, further comprising a handle to attach or detach the cartridge, wherein the knob is disposed adjacent to the handle.

11. The cartridge of claim 10, wherein the knob is slid in a moving direction of the contact portion.

12. The cartridge of claim 10, wherein the handle is pivotable between a holding position protruding from the cartridge and an accommodation position that is close to the cartridge, wherein the moving member is moved in connection with pivoting of the handle.

13. The cartridge of claim 12, further comprising a connection member connected to the handle and moved in a direction orthogonal to a moving direction of the contact portion according to pivoting of the handle, and comprises a guide post, wherein an inclination guide groove, which is inclined with respect to the moving direction of the contact portion and into which the guide post is inserted, is formed in the knob.

14. The cartridge of claim 2, wherein the knob is a rotational knob and the cartridge further comprises:

a pinion that rotates via the knob; and a rack gear that is formed on the moving member to be engaged with the pinion.

15. The cartridge of claim 1, further comprising:

a moving member on which the contact portion is mounted, wherein the moving member is moved to the first or second position; and a handle that is pivoted between a holding position protruding from the cartridge and a first accommodation position that is close to the cartridge, wherein the moving member is moved to the first or second position in connection with pivoting of the handle.

16. The cartridge of claim 15, further comprising an accommodation portion that is dented so as to accommodate the handle located at the first accommodation position.

17. The cartridge of claim 16, further comprising a conversion unit that converts pivotal movement of the handle to sliding movement of the moving member.

18. The cartridge of claim 17, wherein the handle is slid from the holding position to a second accommodation position at which the handle is accommodated in the accommodation portion.

19. The cartridge of claim 18, wherein a pivot shaft of the handle is connected to the conversion unit when the handle is located at the holding position and the first accommodation position, and wherein when the handle is located at the second accommodation position, the pivot shaft of the handle is released from the conversion unit.

20. The cartridge of claim 1, further comprising a toner containing unit containing toner.

21. The cartridge of claim 1, comprising:

a development roller; and a toner containing unit containing toner to be supplied to the development roller.

22. The cartridge of claim 1, comprising:

a toner containing unit containing toner;

a photoconductor on which an electrostatic latent image is formed; and a development roller that supplies the toner of the toner containing unit to the electrostatic latent image.

23. An image forming apparatus comprising:

a main body; and a cartridge of claim 1, wherein the cartridge is attached to or detached from the main body.

24. The image forming apparatus of claim 23, further comprising:

a moving member on which the contact portion is mounted, wherein the moving member is moved to the first or second positions, the knob is connected to the moving member so as to move the moving member.

25. The image forming apparatus of claim 24, further comprising a protection member moved, as the contact portion is moved to the first or second position, to a retreat position hidden in the cartridge and a protruding position protruding out of the cartridge in order to be inserted into an insertion portion provided in the main body.

26. The image forming apparatus of claim 25, wherein the protection member is inserted into the insertion portion before the contact portion is connected to the connection portion so as to align the contact portion and the connection portion.

27. The image forming apparatus of claim 26, wherein a front end portion of the protection member protrudes further than a front end portion of the contact portion in a moving direction of the contact portion.

28. The image forming apparatus of claim 26, wherein the contact portion is moved in a length direction of the cartridge that is orthogonal to a mounting direction of the cartridge, wherein the protection member is disposed before the contact portion in the mounting direction of the cartridge.

29. The image forming apparatus of claim 26, wherein the protection member is integrally formed with the moving member.

30. The image forming apparatus of claim 24, further comprising a handle to attach or detach the cartridge, wherein the knob is disposed adjacent to the handle.

31. The image forming apparatus of claim 30, wherein the handle is pivotable between a holding position protruding from the cartridge and an accommodation position that is close to the cartridge, wherein the moving member is moved in connection with pivoting of the handle.

32. The image forming apparatus of claim 23, further comprising:

a moving member on which the contact portion is mounted, wherein the moving member is moved to the first or second position; and a handle that is pivoted between a holding position protruding from the cartridge and a first accommodation position that is close to the cartridge, wherein the moving member is moved to the first or second position in connection with pivoting of the handle.

33. The image forming apparatus of claim 32, further comprising an accommodation portion that is dented so as to accommodate the handle located at the first accommodation position.

34. The image forming apparatus of claim 33, further comprising a conversion unit that converts pivotal movement of the handle to sliding movement of the moving member.

35. The image forming apparatus of claim 34, wherein the handle is slid from the holding position to a second accommodation position at which the handle is accommodated in the accommodation portion.

36. The image forming apparatus of claim 35, wherein a pivot shaft of the handle is connected to the conversion unit when the handle is located at the holding position and the first accommodation position, wherein when the handle is located at the second accommodation position, the pivot shaft of the handle is released from the conversion unit.

37. The image forming apparatus of claim 23, further comprising a toner containing unit containing toner.

38. The image forming apparatus of claim 23, comprising:

a development roller; and a toner containing unit containing toner to be supplied to the development roller.

39. The image forming apparatus of claim 23, comprising:

a toner containing unit containing toner;

a photoconductor on which an electrostatic latent image is formed; and a development roller that supplies the toner of the toner containing unit to the electrostatic latent image.

40. An image forming apparatus comprising:

a main body having an opening portion and including a door that opens and closes the opening portion; and a cartridge attached to or detached from the main body through the opening portion, wherein the cartridge comprises:

a memory unit including a contact portion via which the cartridge is to be connected to the main body and connected to the main body to transmit information of the cartridge to the main body;

a moving member on which the contact portion is mounted, wherein the moving member is moved to a first position at which the contact portion is located inside the cartridge and a second position at which the contact portion protrudes out of the cartridge to be connected to a connection portion in the main body; and a knob connected to the moving member so as to move the moving member, wherein an interference portion, that contacts the knob such that the door is not closed when the contact portion is located at the first position, is provided on the door.

41. An image forming apparatus comprising:

a door for opening and closing a compartment for the insertion and removal of a cartridge from the compartment;

wherein the cartridge comprises a memory unit that includes a contact portion via which the cartridge is connected to a main body of the image forming apparatus and is connected to the main body to transmit information of the cartridge to the main body, and further comprises a moving member on which the contact portion is mounted and which connects to a knob, wherein the main body has a connection portion, wherein the opening and closing of the door causes the connection portion to extend or retract to allow the connection portion to establish or release a connection with the contact portion, and wherein an interference portion that contacts the knob such that the door is not closed when the contact portion is located at a predetermined position, is provided on the door.

42. A cartridge that is attached to or detached from a main body of an image forming apparatus, the main body including an opening and a door to open/close the opening, the cartridge comprising:

a memory unit that includes a contact portion via which the memory unit is electrically connected to the main body to transmit information of the cartridge to the main body, wherein the contact portion is configured to move to a first position where the contact portion is hidden in the cartridge and to a second position where the contact portion protrudes out of the cartridge in order to be connected to a connection portion provided in the main body; and a protection member that is moved, as the contact portion is moved to the first or second position, to a retreat position where the protection member is hidden in the cartridge and a protruding position where the protection member protrudes out of the cartridge in order to be inserted into an insertion portion provided in the main body.

43. The cartridge of claim 42, wherein the protection member is inserted into the insertion portion before the contact portion is connected to the connection portion so as to align the contact portion and the connection portion.

44. The cartridge of claim 43, wherein a front end portion of the protection member protrudes further than a front end portion of the contact portion in a moving direction of the contact portion.

45. The cartridge of claim 42, wherein the contact portion is moved in a length direction of the cartridge that is orthogonal to a mounting direction of the cartridge, wherein the protection member is disposed before the contact portion in the mounting direction of the cartridge.

46. The cartridge of claim 42, further comprising:

a moving member, on which the contact portion is mounted, wherein the moving member is moved to the first or second position, wherein a knob is connected to the moving member so as to move the moving member.

47. The cartridge of claim 46, wherein the protection member is integrally formed with the moving member.

48. The cartridge of claim 46, wherein the knob is formed at a rear portion of the cartridge with respect to a mounting direction of the cartridge.

49. The cartridge of claim 46, wherein the cartridge is attached to or detached from the main body through an opening portion formed in the main body, wherein the knob is installed at a portion of the cartridge facing the opening portion.

50. The cartridge of claim 46, further comprising a handle to attach or detach the cartridge, wherein the knob is disposed adjacent to the handle.

51. The cartridge of claim 50, wherein the handle is pivotable between a holding position protruding from the cartridge and an accommodation position that is close to the cartridge, wherein the moving member is moved in connection with pivoting of the handle.

52. The cartridge of claim 51, further comprising a connection member connected to the handle and moved in a direction orthogonal to a moving direction of the contact portion according to pivoting of the handle, and comprises a guide post, wherein an inclination guide groove, which is inclined with respect to the moving direction of the contact portion and into which the guide post is inserted, is formed in the knob.

53. The cartridge of claim 46, wherein the knob is a rotational knob and the cartridge further comprises:

a pinion that rotates via the knob; and a rack gear that is formed on the moving member to be engaged with the pinion.

54. The cartridge of claim 42, further comprising:

a moving member on which the contact portion is mounted, wherein the moving member is moved to the first or second position; and a handle that is pivoted between a holding position protruding from the cartridge and a first accommodation position that is close to the cartridge, wherein the moving member is moved to the first or second position in connection with pivoting of the handle.

55. The cartridge of claim 54, further comprising an accommodation portion that is dented so as to accommodate the handle located at the first accommodation position.

56. The cartridge of claim 55, further comprising a conversion unit that converts pivotal movement of the handle to sliding movement of the moving member.

57. The cartridge of claim 56, wherein the handle is slid from the holding position to a second accommodation position at which the handle is accommodated in the accommodation portion.

58. The cartridge of claim 57, wherein a pivot shaft of the handle is connected to the conversion unit when the handle is located at the holding position and the first accommodation position, and wherein when the handle is located at the second accommodation position, the pivot shaft of the handle is released from the conversion unit.

59. The cartridge of claim 42, further comprising a toner containing unit containing toner.

60. The cartridge of claim 42, further comprising at least one of a development roller; and a toner containing unit containing toner to be supplied to the development roller.

61. The cartridge of claim 42, comprising:

a toner containing unit containing toner;

a photoconductor on which an electrostatic latent image is formed; and a development roller that supplies the toner of the toner containing unit to the electrostatic latent image.

* * * * *